US012595982B2

(12) United States Patent
Hubbell et al.

(10) Patent No.: US 12,595,982 B2
(45) Date of Patent: Apr. 7, 2026

(54) AMBIDEXTROUS BOLT RELEASE MECHANISM FOR FIREARM

(71) Applicant: Sturm, Ruger & Company, Inc., Southport, CT (US)

(72) Inventors: Reed Matthew Hubbell, Prescott, AZ (US); Benjamin Gerard Hawkins, Sunapee, NH (US); Frank J. Saunders, Jr., Dunbarton, NH (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 18/645,431

(22) Filed: Apr. 25, 2024

(65) Prior Publication Data

US 2024/0361093 A1 Oct. 31, 2024

Related U.S. Application Data

(60) Provisional application No. 63/498,124, filed on Apr. 25, 2023.

(51) Int. Cl.

| | |
|---|---|
| ***F41A 3/68*** | (2006.01) |
| ***F41A 3/72*** | (2006.01) |
| ***F41A 17/36*** | (2006.01) |
| ***F41A 35/06*** | (2006.01) |

(52) U.S. Cl.
CPC *F41A 3/72* (2013.01); *F41A 3/68* (2013.01); *F41A 17/36* (2013.01); *F41A 35/06* (2013.01)

(58) Field of Classification Search
CPC .. F41A 3/68; F41A 17/36; F41A 35/06; F41A 17/40
USPC ..... 89/138
See application file for complete search history.

(56) References Cited

U.S. PATENT DOCUMENTS

| | | | |
|---|---|---|---|
| 4,521,985 | A | 6/1985 | Smith et al. |
| 4,759,144 | A | 7/1988 | Egan et al. |
| 7,219,462 | B2 | 5/2007 | Finn |
| 7,596,900 | B2 | 10/2009 | Robinson et al. |
| 7,661,219 | B1 | 2/2010 | Knight et al. |
| 8,166,691 | B1 | 5/2012 | Karfiol |
| 8,261,652 | B2 | 9/2012 | Findlay |
| 8,327,749 | B2 | 12/2012 | Underwood |
| 8,572,875 | B2 | 11/2013 | Sisgold |
| 9,121,651 | B1 | 9/2015 | Jen |
| 9,417,020 | B2 | 8/2016 | McGinty |
| 9,429,375 | B2 | 8/2016 | Desomma et al. |
| 9,482,480 | B2 | 11/2016 | O'Dell |
| 9,494,378 | B2 | 11/2016 | Gomez |

(Continued)

*Primary Examiner* — Reginald S Tillman, Jr.
(74) *Attorney, Agent, or Firm* — The Belles Group, P.C.

(57) ABSTRACT

A firearm with ambidextrous bolt release mechanism includes a barrel and a bolt slideably mounted in the receiver for axial movement between forward closed breech position in battery with the barrel and a rearward open breech position. A recoil spring biases the bolt forward. A side-mounted bolt catch lever is configured and operable to selectively hold the bolt in the open breech position, and disengage the bolt to reclose the breech when manually actuated. A transversely movable actuator plunger allows a user to release the bolt from the side of the firearm opposite the bolt catch lever side. The plunger comprises an inclined camming surface which slideably engages a mating inclined camming ramp on the lever. Wedging action applied to the bolt catch lever by the plunger rotates the lever about its pivot axis to disengage and release the bolt.

20 Claims, 27 Drawing Sheets

(56) References Cited

U.S. PATENT DOCUMENTS

| | | | | |
|---|---|---|---|---|
| 9,541,340 | B2 | 1/2017 | Fluhr et al. | |
| 9,562,733 | B2 | 2/2017 | Huther | |
| 9,593,897 | B2 | 3/2017 | Larson, Jr. et al. | |
| 9,599,419 | B2 | 3/2017 | McGinty | |
| 9,651,328 | B1 | 5/2017 | Oglesby | |
| 9,810,493 | B2 | 11/2017 | Fluhr et al. | |
| 9,958,223 | B1 | 5/2018 | McGinty | |
| 9,964,372 | B1 | 5/2018 | O'Clair | |
| 9,995,549 | B1 | 6/2018 | Hamby | |
| 10,151,550 | B2 | 12/2018 | Borders | |
| 10,161,701 | B2 | 12/2018 | Paquette et al. | |
| 10,197,353 | B2 * | 2/2019 | Lewis | F41A 3/68 |
| 10,215,513 | B2 | 2/2019 | Cross | |
| 10,228,201 | B2 | 3/2019 | Walther et al. | |
| 10,234,226 | B1 | 3/2019 | Copeland | |
| 10,393,468 | B2 | 8/2019 | Maugham et al. | |
| 10,415,913 | B2 | 9/2019 | Wyssen | |
| 10,704,851 | B1 | 7/2020 | Redillo | |
| 10,753,696 | B1 | 8/2020 | Christopher et al. | |
| 11,287,204 | B2 | 3/2022 | Davidson | |
| 11,320,221 | B2 | 5/2022 | Kastrun | |
| 11,385,008 | B2 | 7/2022 | Markut | |
| 11,512,920 | B1 | 11/2022 | Oglesby | |
| 11,530,886 | B2 | 12/2022 | Bray | |
| 11,536,531 | B1 | 12/2022 | Geissele et al. | |
| 12,123,668 | B2 * | 10/2024 | Kolev | F41A 17/36 |
| 2006/0123683 | A1 | 6/2006 | Garrett et al. | |
| 2022/0196361 | A1 | 6/2022 | Nedev | |

* cited by examiner

AMBIDEXTROUS BOLT RELEASE MECHANISM FOR FIREARM

CROSS-REFERENCE TO RELATED APPLICATIONS

The present application claims the benefit of priority to U.S. Provisional Application No. 63/498,124 filed Apr. 25, 2023, which is incorporated herein by reference in its entirety.

BACKGROUND

The present invention generally relates to firearms, and more particularly to a bolt release mechanism for firearms such as long guns including rifles, carbines, and shotguns.

In firearms such as but not limited to auto-loading firearms, it is desirable to use a bolt catch to lock the bolt in the rearward open breech position for various reasons. For example, one such reason is to allow visual inspection of the chamber to ensure that a round of ammunition (e.g., cartridge) does not remain when placing the firearm in a safe condition in preparation for maintenance or repair of the firearm. Another reason is to allow a round to be manually chambered if the magazine is empty. The bolt catch of the firearm acts as a lock which selectably holds the bolt rearward until manually released by the user through some additional action.

In addition, bolt catches in auto-loading firearms fed by an ammunition magazine are also operable to automatically activate the bolt catch to lock the bolt in the rearward open breech position after firing the last cartridge (round) in the magazine. The user manually activates the bolt catch to disengage and release the bolt forward to reclose the breech after a fresh magazine has been inserted into the firearm.

Improvements in bolt catches are desired which can provide ambidextrous operation of the bolt catch from either side of the firearm while providing a mechanically simple mechanism for enhanced reliability and operation.

SUMMARY OF THE INVENTION

Embodiments of the present invention provide an ambidextrous bolt release mechanism for a firearm. The bolt-catch release mechanism comprises a bolt catch including an axially elongated bolt catch lever pivotably mounted on one side of the firearm, and a spring-biased actuator plunger accessible from the opposite side of the firearm which cooperates with the lever to form an ambidextrous mechanism. The bolt catch lever is configured and operable to engage and lock the axially movable bolt of the firearm action in a rearward open breech position when the lever is engaged with the bolt. The manually operated plunger is transversely oriented to the bolt catch lever and slideably engageable with the lever to cause rotation thereof for disengaging and releasing the bolt from the rearward open breech position. Alternatively, the bolt catch lever may also be manually actuated directly by the user to release the bolt.

In one unique aspect of the present invention, the bolt catch lever in one embodiment includes an inclined camming ramp which forms an operating surface that is in turn acted upon by a complementary angled inclined camming surface defined by a working end of the actuator plunger opposite the operating end which a user depresses inward to actuate the plunger. A flat-to-flat sliding interface is formed in one embodiment between the inclined camming surface and ramp. The camming surface may be defined by a conical tip of the plunger in one implementation.

When the bolt is held and locked in rearward in its open breech position via the bolt catch lever, the inclined camming surface of the actuator plunger acts as a wedge that pries and rotates the bolt catch lever out of engagement with the bolt when the user-accessible operating end of the plunger is pressed inwards to slide the plunger towards the lever. This releases the bolt forward to reclose the breech.

The actuator plunger advantageously permits the user to release the bolt from both sides of the firearm; either by manually moving the integrated bolt catch lever directly on one side of the firearm, or via manually actuating the spring-loaded plunger from the other side. The spring-loaded plunger may be located on the firearm in a position selected for easy actuation by the user's index finger in one embodiment. This allows an ergonomic and natural motion for the user to increase the speed and ease of reloading the firearm, which is particularly beneficial for purposes such as competition shooting. Additionally, the spring-biased plunger is useful for shooters with an opposite dominant hand, which could cause difficulty in accessing the traditional integrated bolt catch lever on one side. These shooters may instead press the plunger inwards for actuation with their non-dominant hand after using this hand to insert the ammunition magazine, thereby permitting a speedy and easy reloading process.

The plunger may be spring-biased in a direction away from the bolt catch lever to the degree that avoids actuation of the lever until the plunger is manually actuated by the user. As a result, the plunger does not hinder mechanical function or movement of the bolt catch with unnecessary added inertial load, friction, or other encumbrances.

BRIEF DESCRIPTION OF THE DRAWINGS

The features of the exemplary embodiments will be described with reference to the following drawings where like elements are labeled similarly, and in which.

Figure 1:
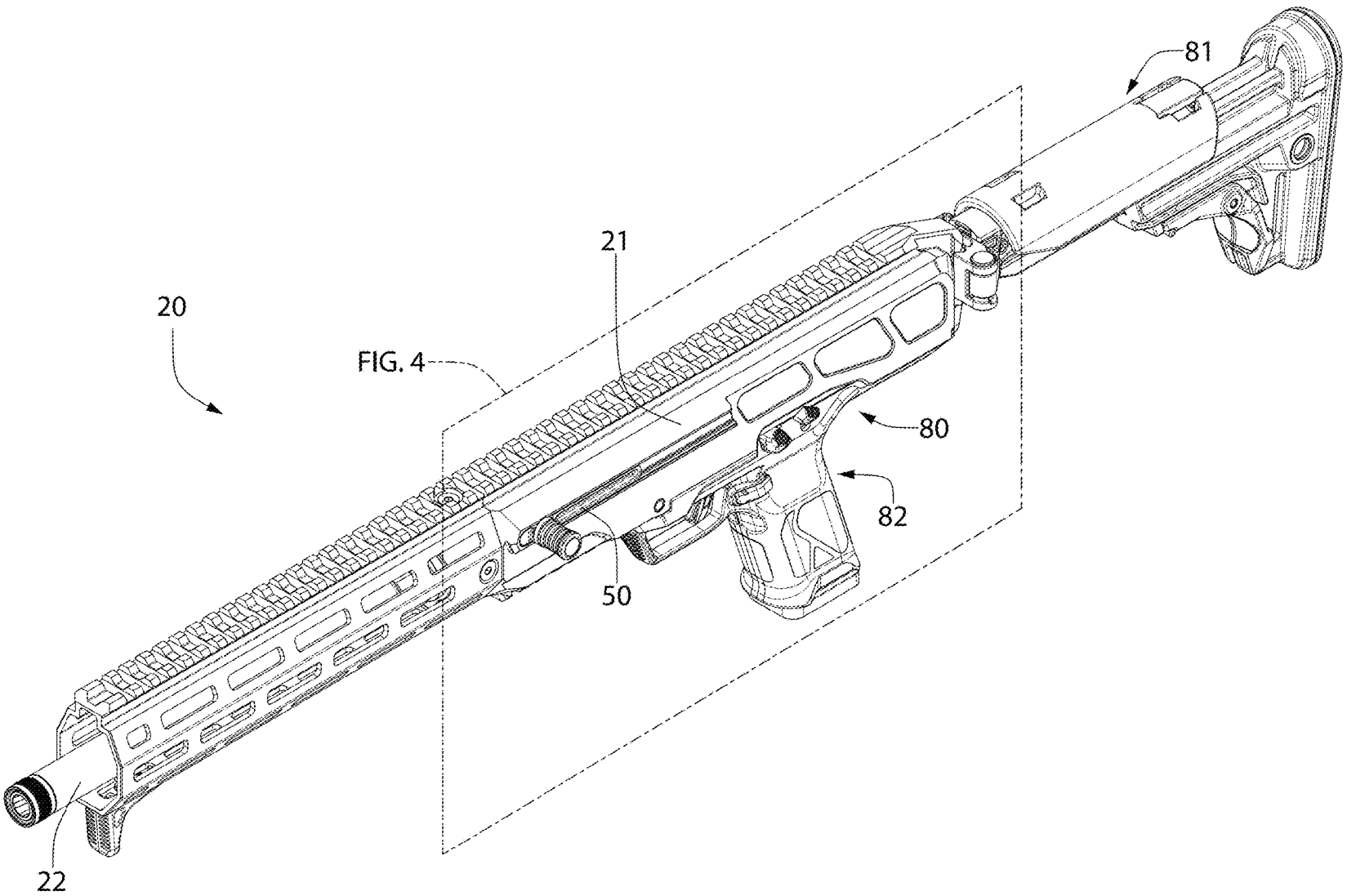
FIG. 1 is a top perspective view of a firearm with bolt catch according to the present disclosure.
Figure 2:
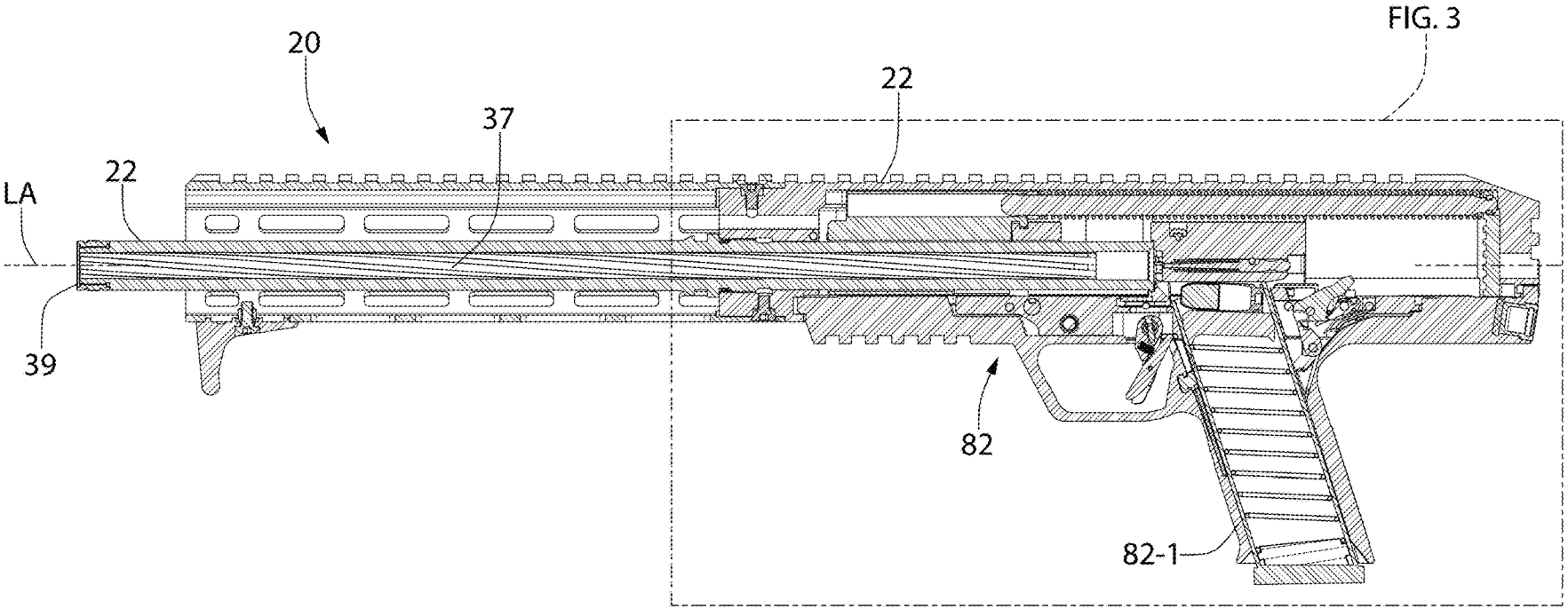
FIG. 2 is a left side cross sectional view thereof.
Figure 3:
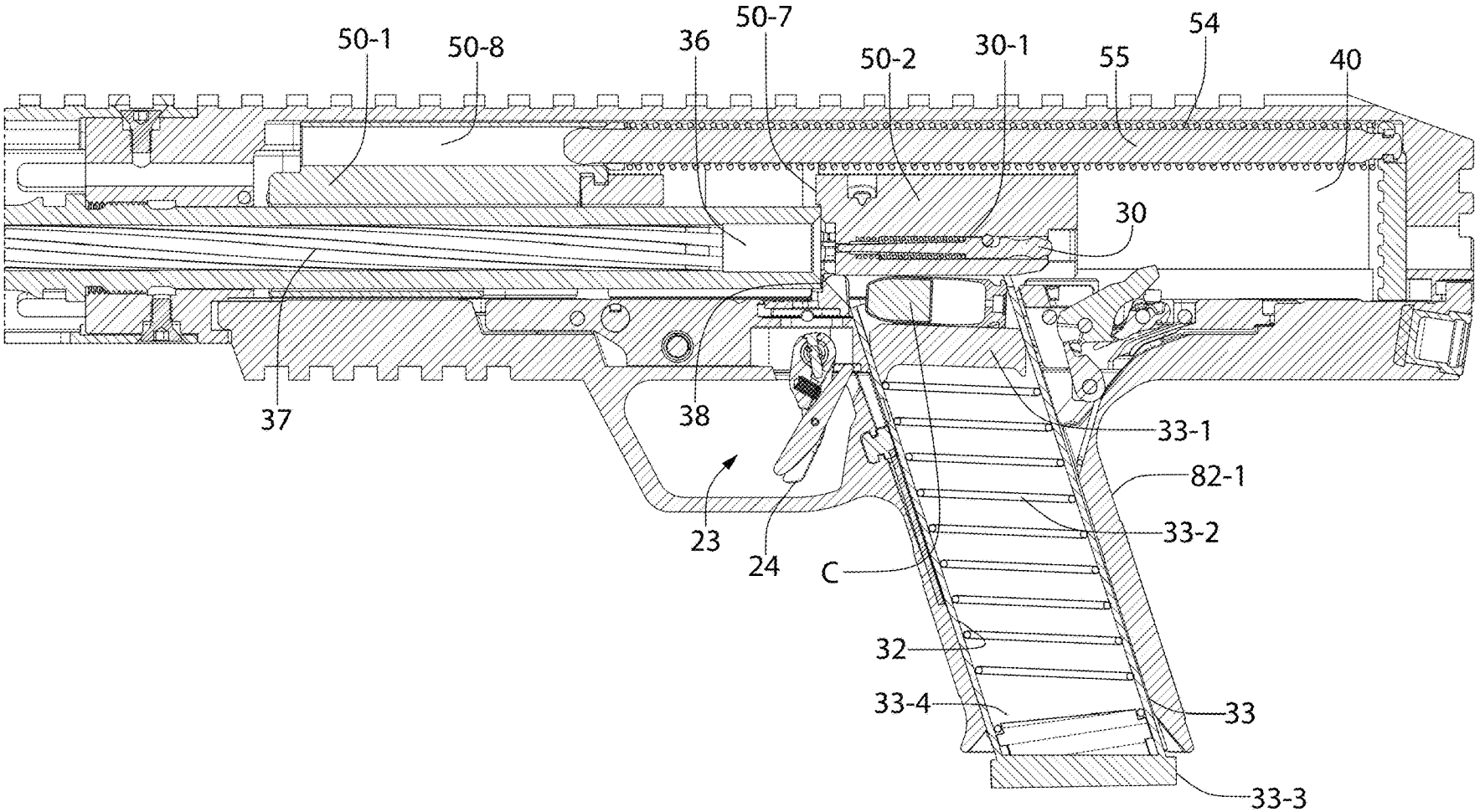
FIG. 3 is an enlarged detail taken from FIG. 2.
Figure 4:
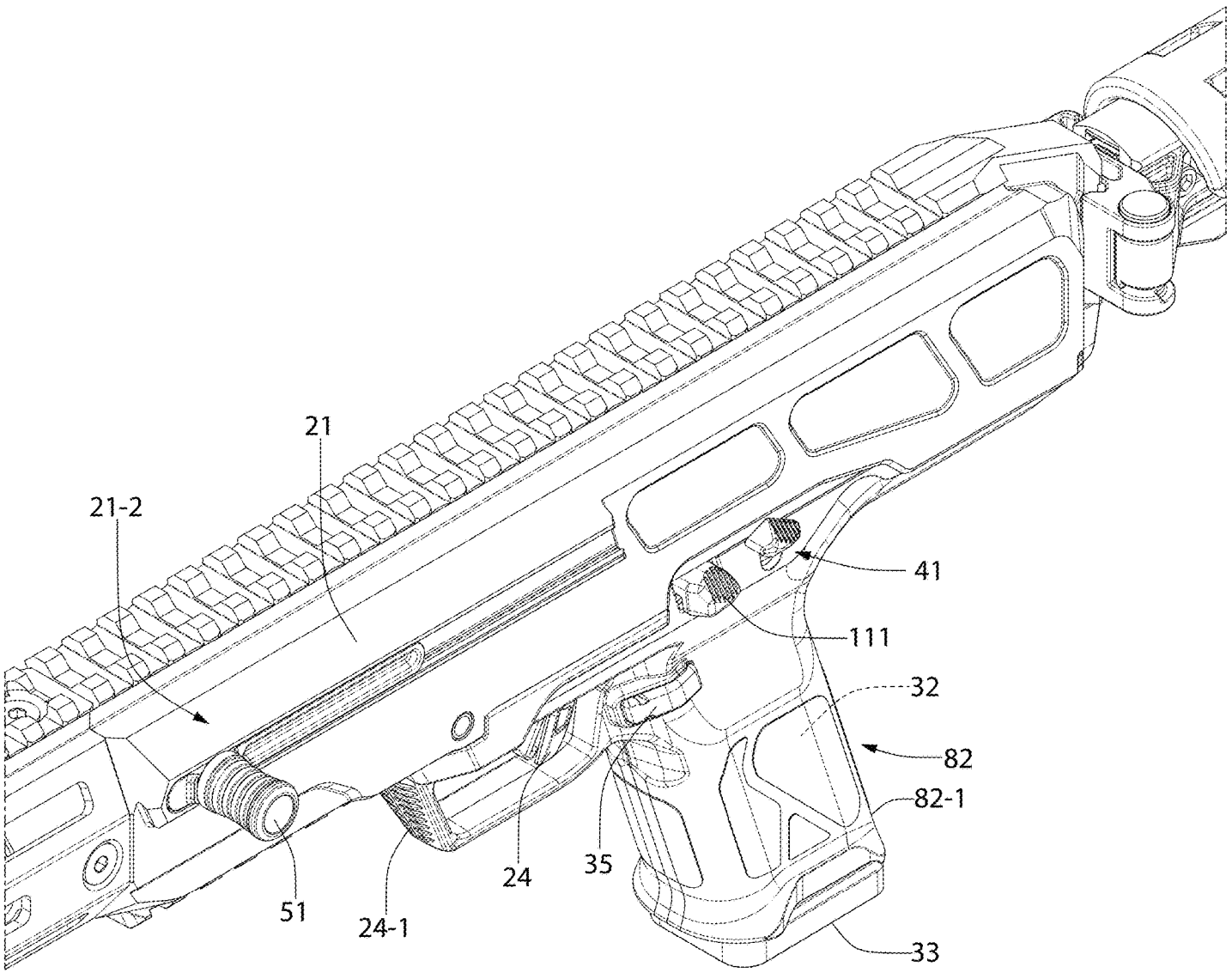
FIG. 4 is an enlarged detail taken from FIG. 1.
Figure 5:
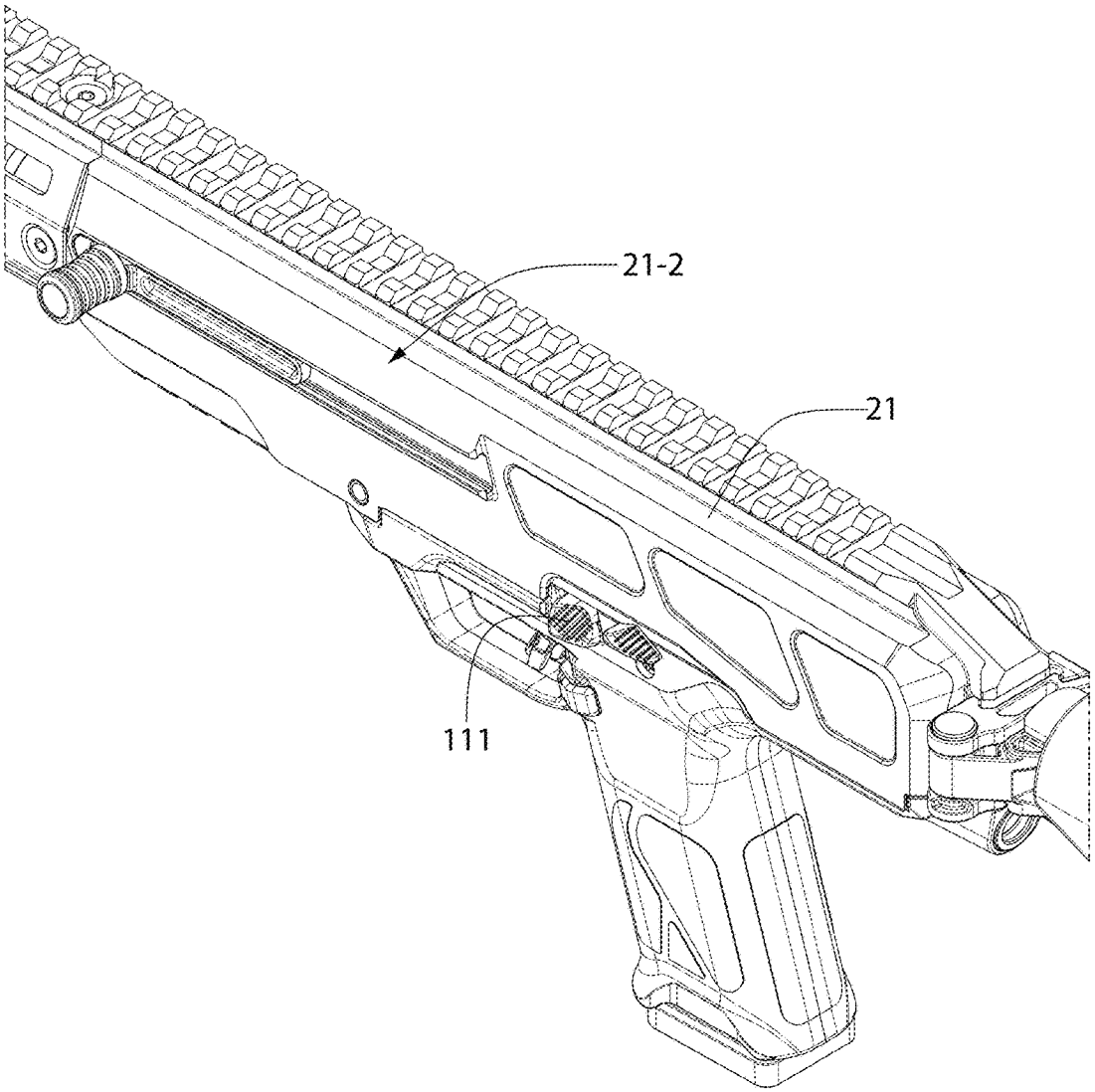
FIG. 5 is a left side rear perspective view of the mid-stock are of the firearm.
Figure 6:
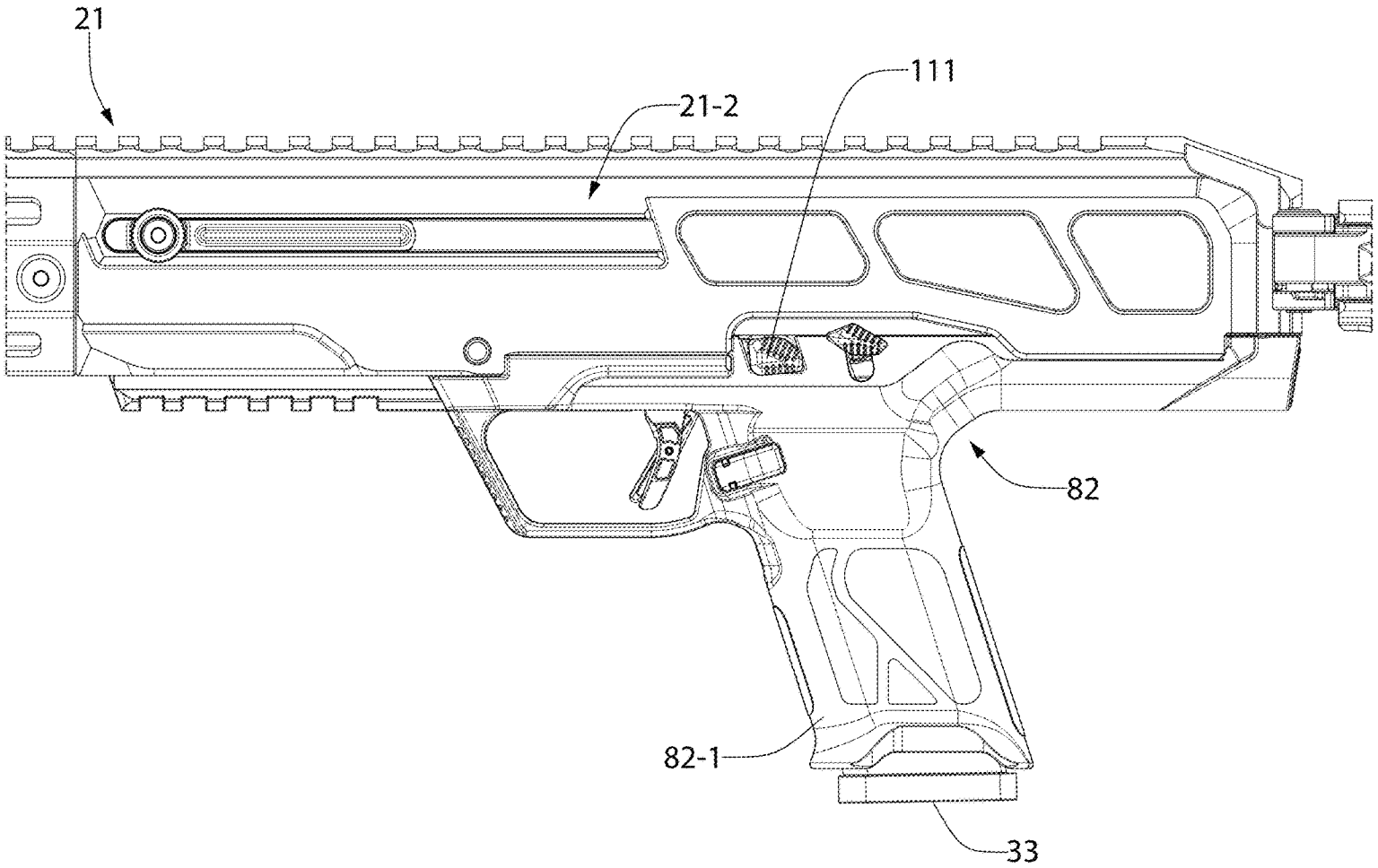
FIG. 6 is a left side view thereof.
Figure 7:
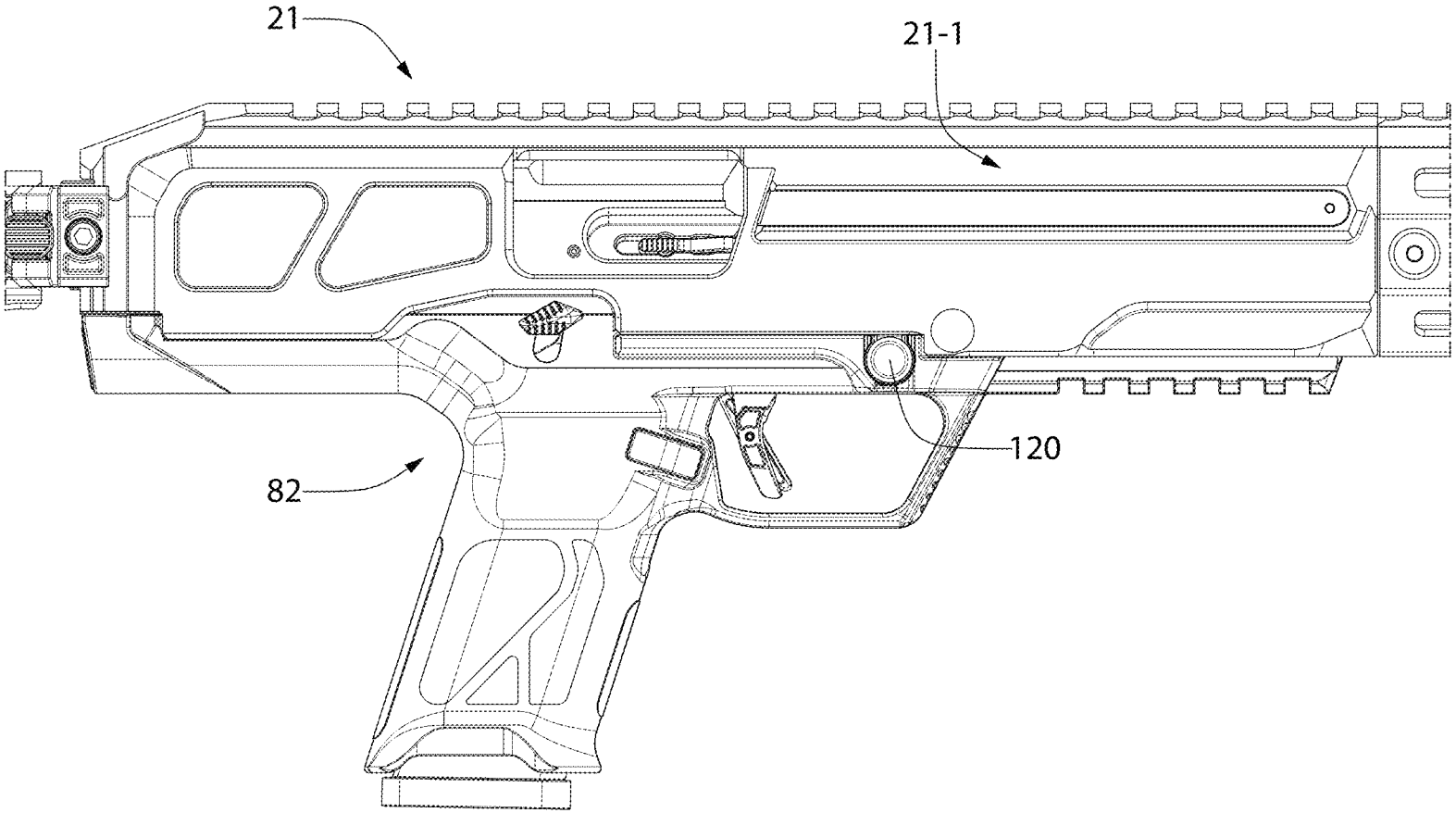
FIG. 7 is a right side view thereof.

All drawings are schematic and not necessarily to scale. Parts shown and/or given a reference numerical designation in one figure may be considered to be the same parts where they appear in other figures without a numerical designation for brevity unless specifically labeled with a different part number and described herein. A reference herein to a figure by a whole number which includes multiple figures sharing the same whole number but with different alphabetical suffixes shall be construed as a general reference to all of those figures unless expressly noted otherwise.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-33 generally depict a magazine-fed autoloading semi-automatic firearm 20 including a bolt release mechanism and various aspects thereof according to the present disclosure. In one non-limiting embodiment, the firearm may be a long gun such as a rifle, carbine, or shotgun. The non-limiting illustrated embodiment, selected for convenience of description only as one representative firearm, shows a carbine which is essentially a rifle with space-efficient barrel projection useful for many purposes such as competitive action shooting. In other embodiments, however, the bolt release mechanism disclosed herein may be applied to pistols to lock the axially movable slide in a rearward open breech position. Accordingly, the bolt catch is not limited in its applicability to any particular firearm format alone in which it is desirable to lock the bolt or slide in a rearward open breech position either manually or automatically via operation of the magazine follower, and to release the bolt forward to reclose the breech.

Firearm 20 includes a longitudinal axis LA, receiver 21, barrel 22 coupled thereto, bolt 50, and a trigger-actuated firing mechanism 23 which may be supported directly by the receiver or alternatively a detachable fire control insert 23-1 as illustrated herein. Firing mechanism 23 includes movable trigger 24 for actuating the mechanism to discharge the firearm. The firearm includes a chassis or stock 80 including buttstock 81 for shouldering the firearm and mid-stock 82 to which the receiver 21 is detachably coupled by any suitable method used in the art such as via mounting pins, threaded fasteners, interlocking surfaces or protrusions, combinations thereof, or other mechanical fastening means. In one embodiment, the mid-stock may be a downwardly extending pistol grip frame 82-1 which defines a magazine well 32. In this case, receiver 21 may be detachably mounted to the pistol grip frame 82-1. Pistol grip frame 82-1 may include a open loop-shaped bottom trigger guard 24-1 which surrounds and helps protect the trigger 24 against unintentional actuation.

Downwardly and upwardly open magazine well 32 detachably holds ammunition magazine 33 comprising an internal magazine cavity 33-4 containing a plurality of cartridges (rounds) mounted therein. Such magazines may have a straight or curved box-type in some embodiments which contains a spring-biased stack of ammunition cartridges which are uploaded into the breech area 34 by a spring feed mechanism for chambering into the rearwardly open chamber 36 of barrel 22 by the bolt 50 in a conventional manner when cycling the action (example of box-type magazine illustrated in the figures). The spring feed mechanism disposed in magazine cavity 33-4 includes a follower 33-1 which supports a vertical stack of cartridges C and magazine spring 33-2 which acts on the follower to bias the cartridges upwards towards the open top of the magazine for feeding into the breech area of the receiver in a conventional manner (see, e.g., FIG. 3). Spring 33-2 acts between magazine floor plate 33-3 coupled to the bottom of the magazine tube and the bottom of follower 33-1 at top. The follower is operably interfaced with the bolt catch 100 to automatically actuate the catch to lock the bolt rearward as a last round hold open feature, further described herein. Any type of cartridges may be used depending on the type of cartridge for which the firearm is chambered, including centerfire or rimfire cartridges both of which are well known in the art without further undue claboration.

The magazine 33 is removably retained in the magazine well 32 by a movable magazine latch 35. Latch 35 may be slideably mounted to pistol grip frame 82-1 of the mid-stock 82 in one embodiment and is configured to alternatingly lock the magazine in the firearm or release the magazine when the latch is manually actuated by the user. Latch 35 may be mounted in the front of pistol grip frame 82-1 proximate to the front of the magazine well 32 in one embodiment as shown for front latching type magazines. However, latch 35 may alternatively be mounted on either side of the pistol grip frame 82-1 or at the rear thereof if other latching type magazines are used. The location of the latch does not limit the present invention in any manner.

Barrel 22 includes an axial bore 37 extending longitudinally and axially from a rear breech end 38 to a front muzzle end 39 of the barrel. The bore 37, which may be rifled, defines a projectile passageway through which a bullet or slug is discharged from the firearm. The centerline of bore 37 is coaxial with and defines the longitudinal axis LA of the firearm. The rear breech end 38 of the barrel 22 defines a rearwardly open diametrically enlarged chamber 36 configured for holding a cartridge. Chamber 36 communicates with barrel bore 37.

Receiver 21 defines an axially elongated internal cavity 40 which slidably carries and supports the bolt 50. Cavity 40 extends along the longitudinal axis LA between the open front end 18 in communication with the barrel chamber 36 for loading cartridges therein and a closed rear end 19 defined by vertical rear end wall 43. Barrel 22 is coupled to the front end 18 of the receiver via any suitable method used in the art. The receiver is detachably coupled to and supported by the frame 82.

For convenience of assembly and maintenance/repair, the firing mechanism 23 in one embodiment as shown may be housed and mounted in a separate fire control insert 23-1 (see, e.g., FIGS. 12 and 14-23). Fire control insert 23-1 is detachably and removably mounted to the lower portion of the mid-stock 82 such as to the pistol grip frame 82-1 in the illustrated embodiment via any suitable method used in the art such as for example without limitation via mounting pins, threaded fasteners, interlocking surfaces or protrusions, combinations thereof, or other mechanical fastening means. Other suitable type fastening means however may be used. Grip frame 82-1 defines an upwardly open longitudinal receptacle 82-2 which receives the fire control insert and certain components of the fire control system therein (see, e.g., FIG. 12). The fire control insert 23-1 includes an internal cavity 23-2 for mounting various fire control components further described herein.

In one embodiment, firearm 20 may include a rotatable manual safety mechanism 41 is transversely movably mounted in fire control insert 23-1 and configured to interact with a component of the firing mechanism for rendering the firing mechanism in either a disabled (safe) or enabled (fire) condition. Safety 41 may be an ambidextrous safety operably from either lateral side of the firearm. Such a safety may include right safety operating button 41-2 operably coupled to a left safety operating button 41-1 via a transversely mounted shaft 41-3 extending from side-to-side through the fire control insert.

Fire control insert 23-1 may be formed of any suitable metallic and/or reinforced polymeric material in some embodiments. The fire control insert has an axially elongated body defining a front end 70, rear end 71, right lateral side 72, and left lateral side 73. The fire control insert body extends along the longitudinal axis LA and may include features to key the insert into the pistol grip frame 82-1 for proper alignment therewith to couple these components together as described elsewhere herein.

In addition to trigger 24, the firing mechanism 23 may include the following additional components mounted to the fire control insert 23-1: a pivotable and cockable spring-biased hammer 25; spring-biased pivotable sear 26 which is configured and operable to hold the hammer in a rear cocked position, and trigger bar 27 operably coupled between and to the trigger and sear for actuating the sear via a trigger pull to release the hammer from the cocked position for firing the firearm. Trigger pivot 24-1 mounts trigger 24 to the fire control insert in a pivotable manner in one embodiment. Trigger spring 24-1 may be a torsion spring with a coil portion mounted about the trigger pin to bias the trigger 24 forward to a ready-to-fire position, and a rearward extending leg which acts on the trigger bar 27 to bias it upwards for engagement of a sear operating protrusion 27-1 at the rear end of the trigger bar with the sear.

Hammer 25 is biased forward towards a front firing position by hammer spring 31. Scar 26 is biased towards engagement with the hammer via sear spring 26-1. Pulling the trigger 24 rearward shifts the trigger bar 27 forward which in turn rotates the sear 26 via sear operating protrusion 27-1 on the trigger bar. This disengages a hook or ledge 28 formed on the front of the sear from sear notch 29 on the hammer 25, thereby releasing spring-biased hammer 25 forward which strikes the rear end of firing pin 30 slidably carried by the bolt 50. This drives the firing pin forward to strike a chambered cartridge held in the chamber 36 of the barrel 22 for discharging the firearm 20.

Referring generally to FIGS. 3 and 8-13, bolt 50 in one embodiment may comprise an axially elongated block-shape metal body of generally rectilinear (e.g. rectangular cuboid) shape. Bolt 50 may have a monolithic unitary structure, or alternatively may be a two-piece construction as illustrated herein comprising a front bolt piece 50-1 and rear bolt piece 50-2 coupled together. The two-piece construction allows the weight of the bolt to be altered via swapping out one bolt piece with a heavier or lighter weight, which affects the recoil of the bolt when the firearm is fired based on the caliber of the cartridge used. The bolt therefore is customizable to ensure proper cycling of the action.

The bolt pieces 50-1, 50-2 may be detachably coupled together in one embodiment as shown, or permanently joined together. A keyed coupling may be provided formed by a U-shaped coupling protrusion 50-3 on the front of the rear bolt piece which slideably engages a complementary configured coupling channel 50-4 formed on the rear of the front bolt piece. When the front and rear bolt pieces are mutually engaged, the two pieces are axially interlocked together to prevent separation when the bolt assembly 50 is moved between the rearward open breech position and forward closed breech position in battery with the barrel.

It bears noting that the front and rear bolt pieces are keyed into one another by the interlocked coupling protrusion and channel axially (longitudinally), vertically by the receiver and fire control insert, and horizontally by the receiver. There are no fasteners or screws required to hold the front and rear bolt sections together in the present embodiments.

For convenience of general reference, the assembled bolt 50 generally includes a front end 52, rear end 53, top 56, bottom 57, and a pair of longitudinally-extending opposing right and left lateral sides 58 defined by planar sidewalls of the bolt body. For the illustrated two-piece bolt construction, these foregoing general positional locations refer to the assembled bolt, not each piece alone.

Front and rear bolt pieces 50-1, 50-2 each comprise a longitudinal passage 50-5, 50-6 respectively coaxial with longitudinal axis LA of the firearm into and through which the rear breech end 38 of barrel 22 is inserted and extends. Passage 50-5 extends complete through front bolt piece 50-1 between front end 50-1A and 50-1B. Passage 50-6 extends through front end 50-2A of rear bolt piece 50-1 and terminates at a vertical breech face 50-7 partway inside the passage which is spaced inward from rear end 50-2B of the bolt piece (see, e.g., FIG. 13). By extending the barrel 22 a distance inside the receiver and bolt via passage 50-5 advantageously allows the forward projected length of the barrel to be short for a carbine type firearm. The vertical breech face 50-7 of the bolt engages the rear breech end 38 of the barrel 22 adjacent the cartridge chamber 36 when the breech is closed.

Bolt 50 is received and axially movable in the internal cavity 40 of the receiver 21 along longitudinal axis LA between forward closed breech and rearward open breech positions. In the closed breech position, the bolt 50 (i.e. breech face 50-7 of rear bolt piece 50-2) is in battery with the rear breech end 38 of barrel 22 to close the chamber 36 for firing. In the open breech position, the bolt is axially displaced rearward to allow a spent cartridge casing to be extracted from the barrel chamber and ejected, and for loading a fresh cartridge into the breech area of the receiver for chambering by the bolt when automatically returned forward to the closed breech position by the recoil spring assembly.

The recoil spring assembly includes recoil spring 54 and longitudinally-extending spring guide rod 55 which supports and guides the spring. The spring may be a helical compression spring in one embodiment as shown. The rear end of guide rod 55 extends rearward beyond rear bolt piece 50-2 and is affixed to the rear end of receiver 21 inside receiver internal cavity 40 in a fixed position. The front end of guide rod 55 is slideably received inside axial guide rod passage 50-8 of the front bolt piece 50-1 and projectible forward and rearward in the passage when the bolt moves between its forward and rearward positions. In one embodiment, recoil spring 54 may act on rear end 50-1B of front bolt piece 50-1 alone at the rear entrance to the guide rod passage to bias the entire two-piece bolt assembly forward to the closed breech position. Cavity 40 of receiver 21 therefore has an axial length sufficient to provide the full range of motion necessary for the bolt 50 moving rearward under recoil to open the breech for extracting and ejecting a spent cartridge casing, and moving forward to the closed breech position for feeding a new cartridge into the barrel chamber 36 from the magazine 33.

Bolt 50 may also include a manual charging handle 51 rigidly affixed to one side of the bolt to manually cycle the bolt between its forward and rearward positions by hand thereby allowing a user to lock manually lock the bolt in the rearward open breech position using bolt catch 100, as further described herein. Handle 51 has a transversely elongated body and is laterally projected from one side of the firearm for grasping to cycle the action.

Firing pin 30 of the firing mechanism 23 is movably mounted in a longitudinally-extending firing pin channel 30-1 formed in the bolt body. The rear end of firing pin 30 remains exposed at the rear end 53 of the bolt (see, e.g. FIG. 3) for striking by the hammer 25 to discharge the firearm via a trigger pull.

The manually actuated bolt release mechanism of the present invention and related method for operating the same will now be further described. The bolt release mechanism comprises bolt catch 100 which cooperates and operably interfaces directly with the bolt 50 for locking and retaining the bolt in the rear open breech position, or releasing the bolt forward therefrom to close the breech. FIGS. 24-33 show details of bolt catch assembly in isolation. FIGS. 14-23 show the bolt catch assembly in association with the fire control insert 23-1 to which the bolt catch is operably mounted.

Bolt catch 100 in one embodiment is an assembly comprising bolt catch lever 101 and actuator plunger 120 which cooperates with the lever to form an ambidextrous bolt release. These components may be movably mounted to and supported by the fire control insert 23-1 of the firearm in one embodiment as shown.

Figure 11:
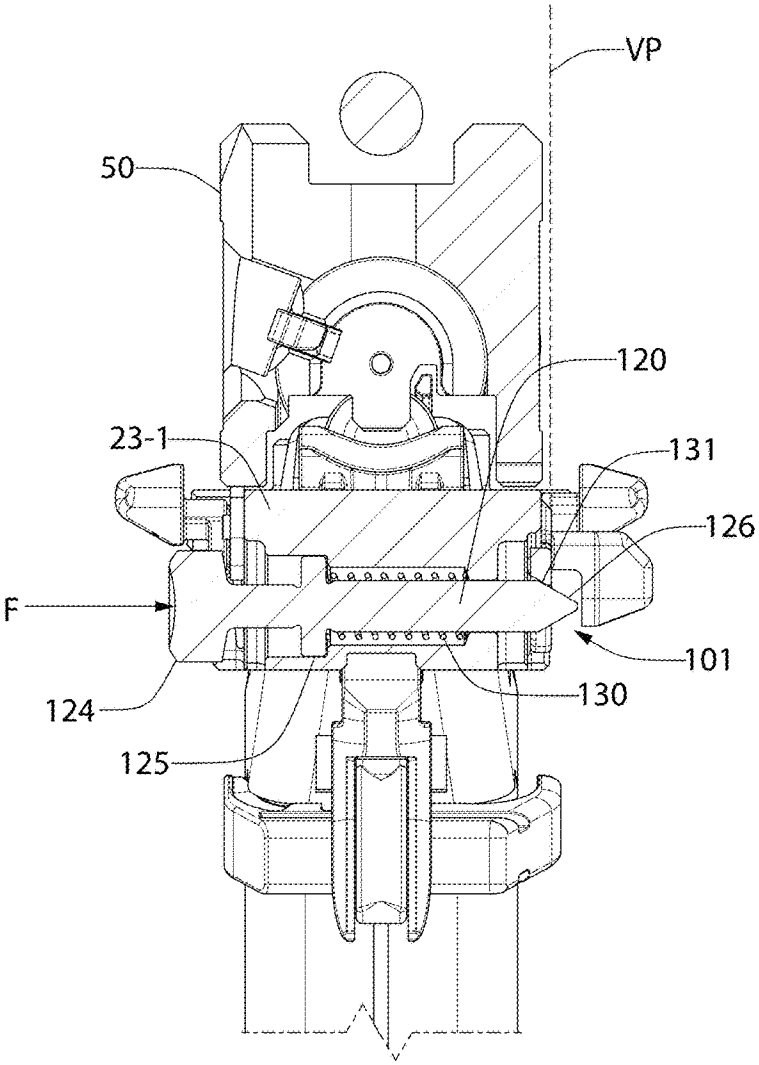
FIG. 11 is a transverse cross sectional view taken from FIG. 9A showing the actuator plunger of the bolt catch in an actuated position slideably engaged with and activating the bolt catch lever to cause rotation thereof to disengage and release the bolt.
Figure 10:
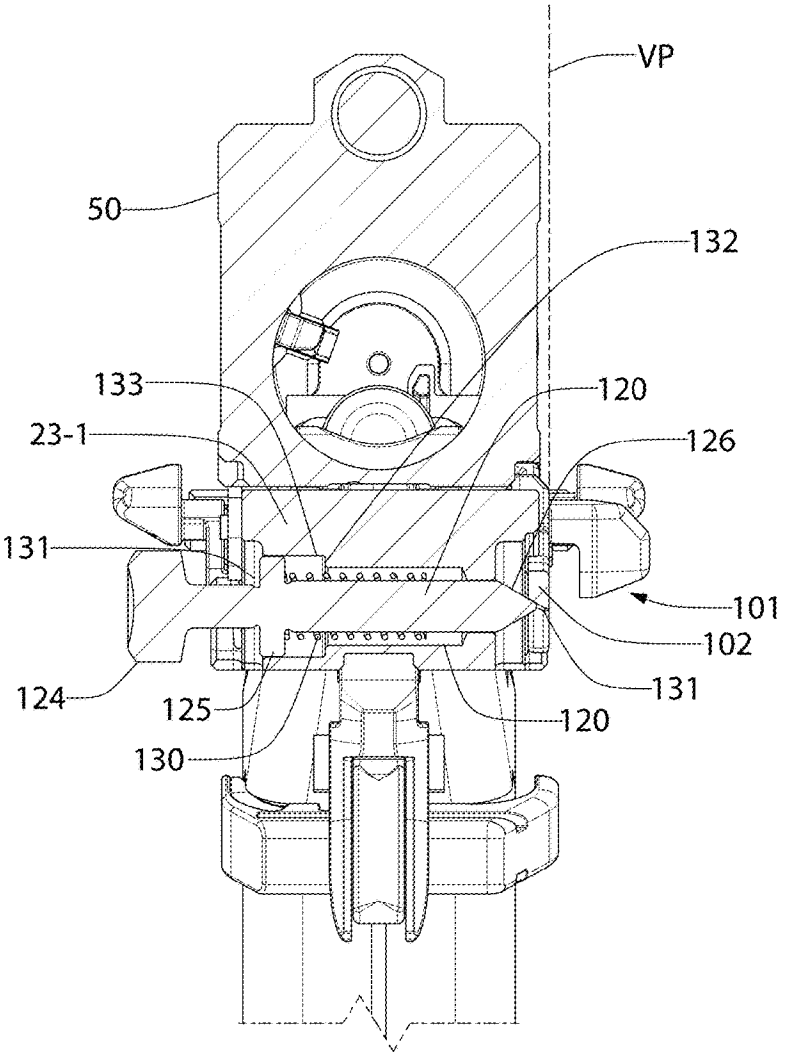
FIG. 10 is a transverse cross sectional view taken from FIG. 8A showing the actuator plunger of the bolt catch in an unactuated position which does not activate the bolt catch lever.
Figure 12:
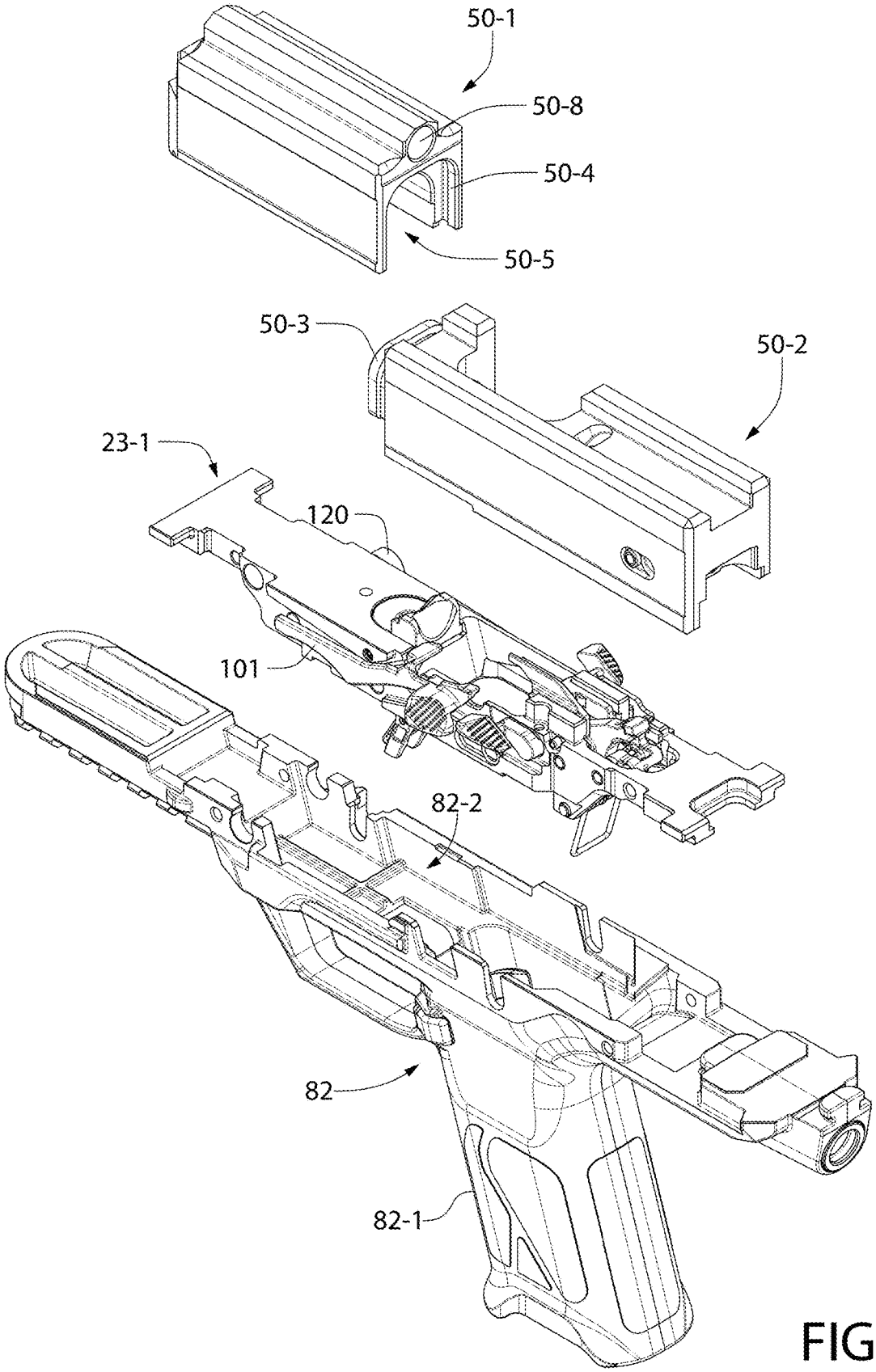
FIG. 12 is a top exploded perspective view of the bolt, fire control insert, and pistol grip frame of the firearm.

Bolt catch lever 101 comprises an elongated metallic body 100-1 which lies in a vertical reference plane VP oriented parallel to the sides of the firearm (see, e.g., FIGS. 10-11). The bolt catch lever 101 is movably disposed on one lateral side of the firearm (e.g., right lateral side 21-1 or left lateral side 21-2 of receiver 21 as shown). The bolt catch lever may be substantially axially elongated in the direction of the longitudinal axis LA of the firearm having an axial length which extends forward of trigger 24 in the fire control insert 23-1 at front and at rear laterally adjacent to central opening 115 of fire control insert 23-1 located directly above and in communication with magazine well 32, as further described herein. Bolt catch lever 101 is rotatable and pivotably movable about its horizontal and laterally oriented pivot axis PA upwards and downwards with toggle-like action in the vertical reference plane VP, as further described herein. The elongated extension of the bolt catch lever forward of pivot axis also provides the benefit of improving inertial balance of the lever, thereby contributing to a balanced and positively acting lever.

The bolt catch lever 101 is therefore vertically and pivotably movable about it pivot axis PA in the vertical reference plane VP relative to the bolt 50 and receiver 21 between an upward engaged position to lock and hold the bolt in its rearward open breech position, and a downward disengaged position which disengages and releases the bolt forward. Operation of the bolt catch 100 is further described elsewhere herein.

Bolt catch lever 101 generally defines a front end 102, rear end 103, exterior and interior sides 104, 105 extending therebetween, top 106, and bottom 107. Sides 104, 105 may be substantially flat portions of the body 100-1 (except for operating features) and parallel to each other in one embodiment as shown.

The operating features of bolt catch lever 101 generally includes a pivot pin 110 which pivotably mounts the lever to fire control insert 23-1, bolt catch protrusion 113 configured to selectively engage a mating locking ledge 114 formed on the bolt 50 to lock the bolt rearward with an open breech until manually released, actuating handle 111 for manually actuating the lever to either manually engage or release the bolt 50, and follower engagement protrusion 112 which is selectively engageable with the follower 33-1 of the magazine 33 as a last round bolt hold open feature after the last cartridge is dispensed to the firearm from the magazine which automatically locks the bolt in the rear open breech position. Each feature is further described below.

Pivot pin 110 extends perpendicularly to the bolt catch lever body 100-1 and transversely inwards from interior side 105 of the bolt catch lever 101 in a horizontal orientation. Pivot pin 110 in one non-limiting embodiments may be located in the middle portion of the lever body 100-1 between ends 102, 103, but not necessary at the midpoint therebetween as shown. Pivot pin 110 defines pivot axis PA of the lever 101 and may have a cylindrical configuration. Pivot pin 110 is rotatably received in a mating round pin mounting hole 110-1 formed in a lateral side of the fire control insert 23-1 to pivotably mount the bolt catch lever to the insert (see, e.g., FIG. 14).

Bolt catch protrusion 113 is configured to protrude both upwards and laterally/transversely inwards from interior side 105 of the bolt catch lever 101 from the rear portion 103-1 of the lever defined between pivot pin 110 and rear end 103. In one embodiment, as shown, bolt catch protrusion 113 may be disposed proximate to rear end 103 of the lever to maximize its vertical range of motion about the lever pivot axis PA. The bolt catch protrusion is configured to operably engage locking ledge 114 formed on the bolt 50 to lock the bolt in its rear open breech position when bolt catch lever 101 is either manually actuated by the user or automatically actuated via operation of the follower engagement protrusion 112 operably interfaced with the magazine as a last round hold open provision.

Figure 8A:
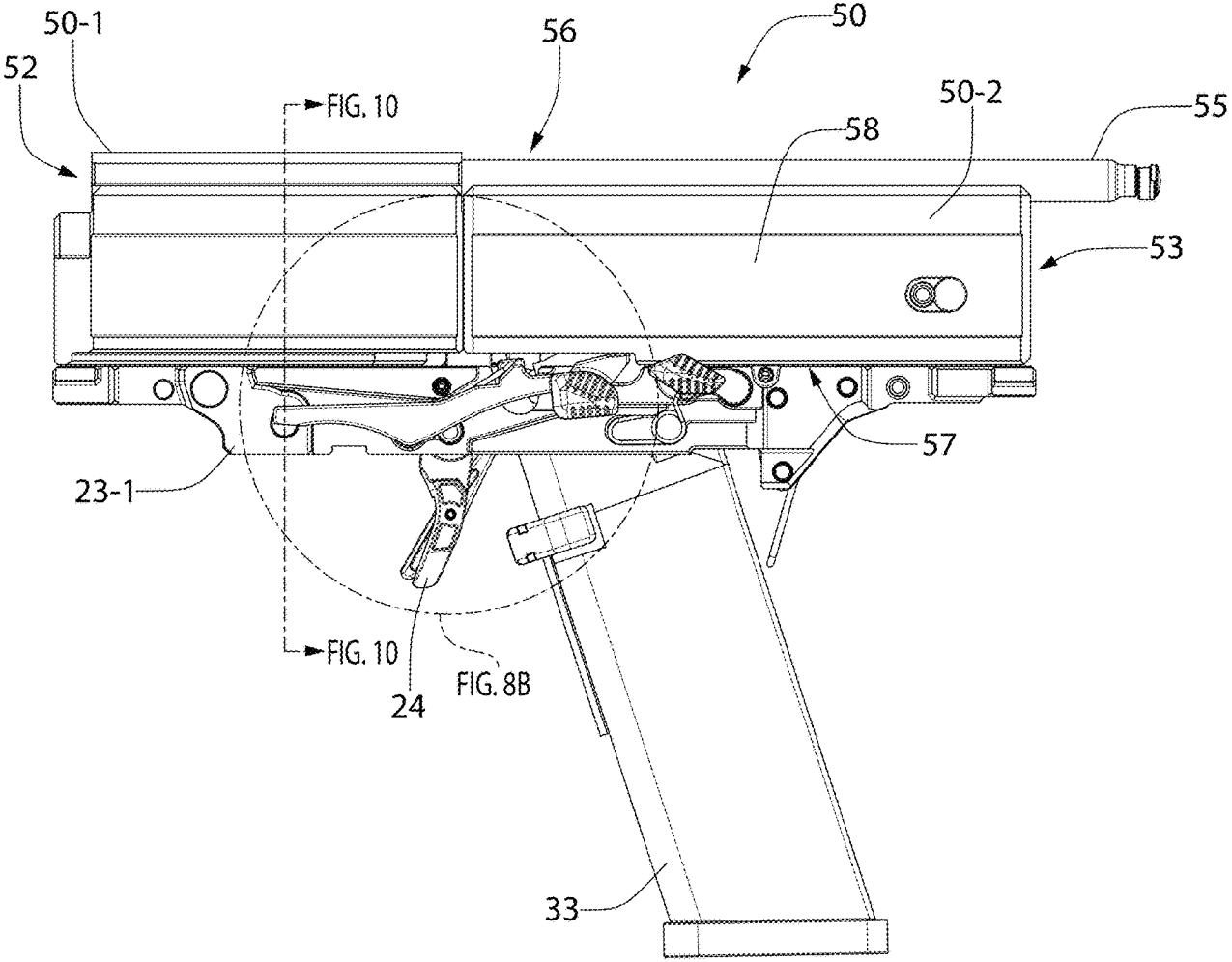
FIG. 8A is left side view of part of the firearm showing the bolt in a rearward open breech position and the bolt catch lever of the bolt catch engaged with the bolt to retain the open breech position.
Figure 8B:
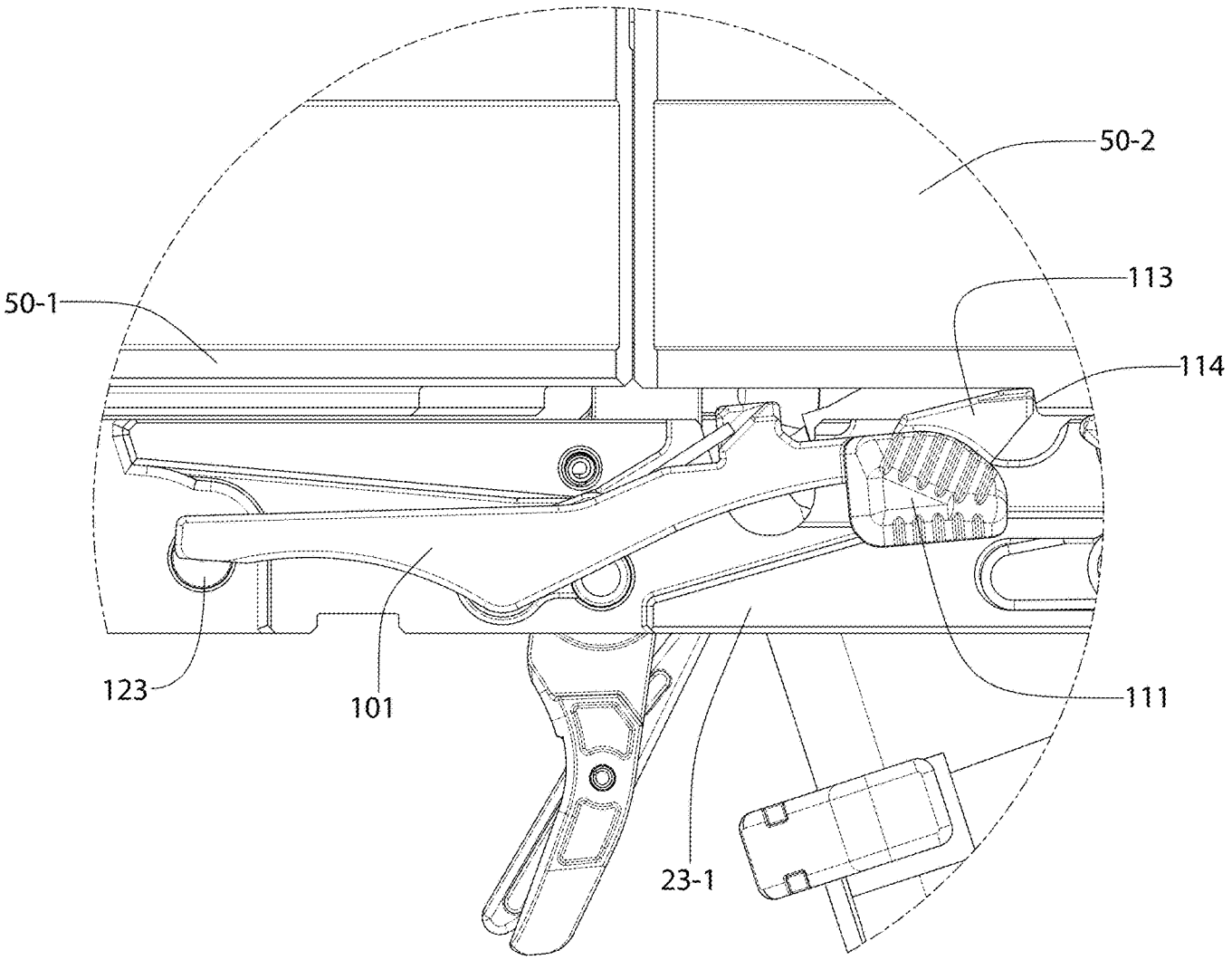
FIG. 8B is an enlarged detail taken from FIG. 8A.
Figure 9A:
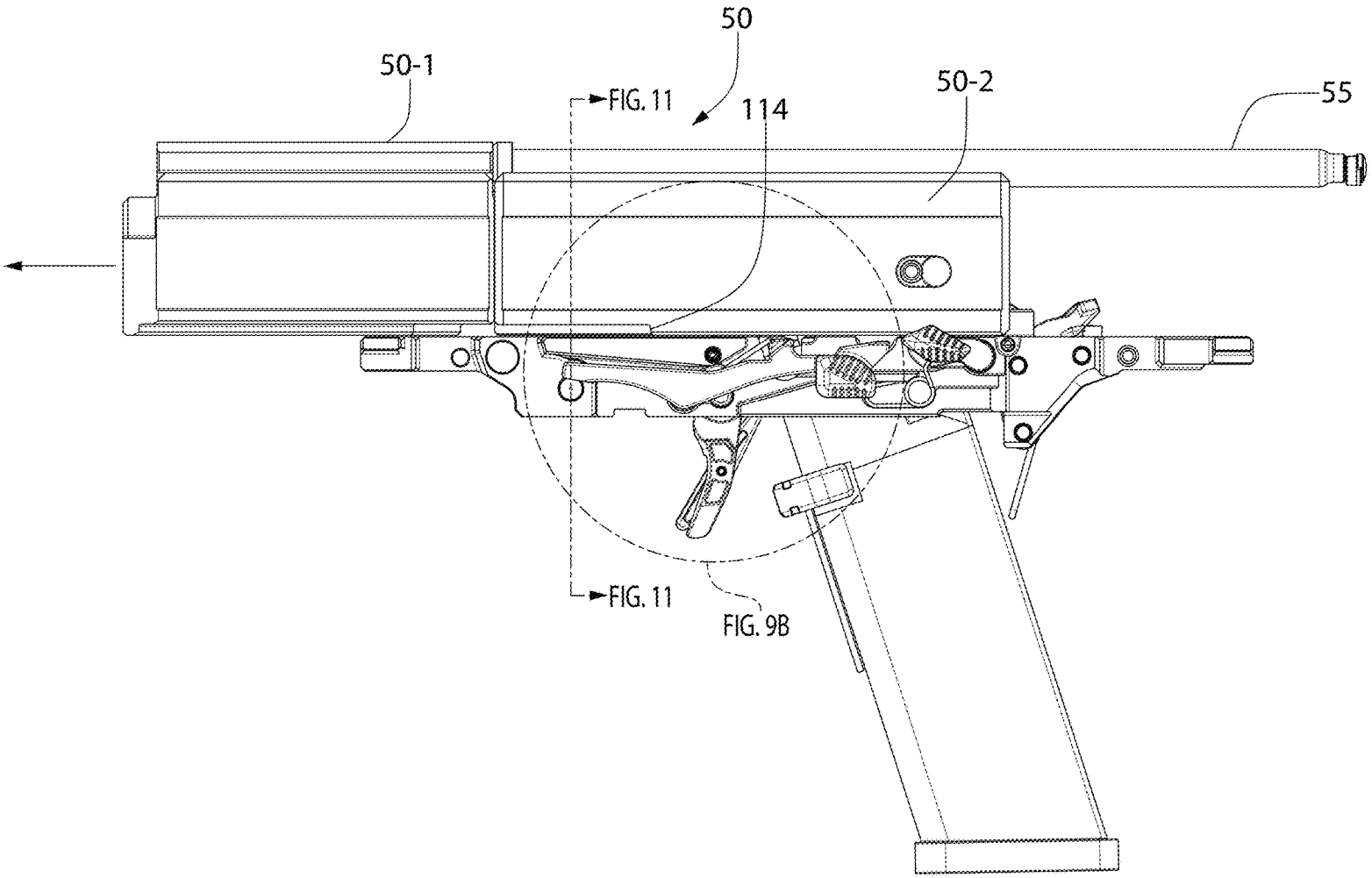
FIG. 9A is left side view of part of the firearm showing the bolt returning forward to the closed breech position and the bolt catch lever disengaged from and releasing the bolt.
Figure 9B:
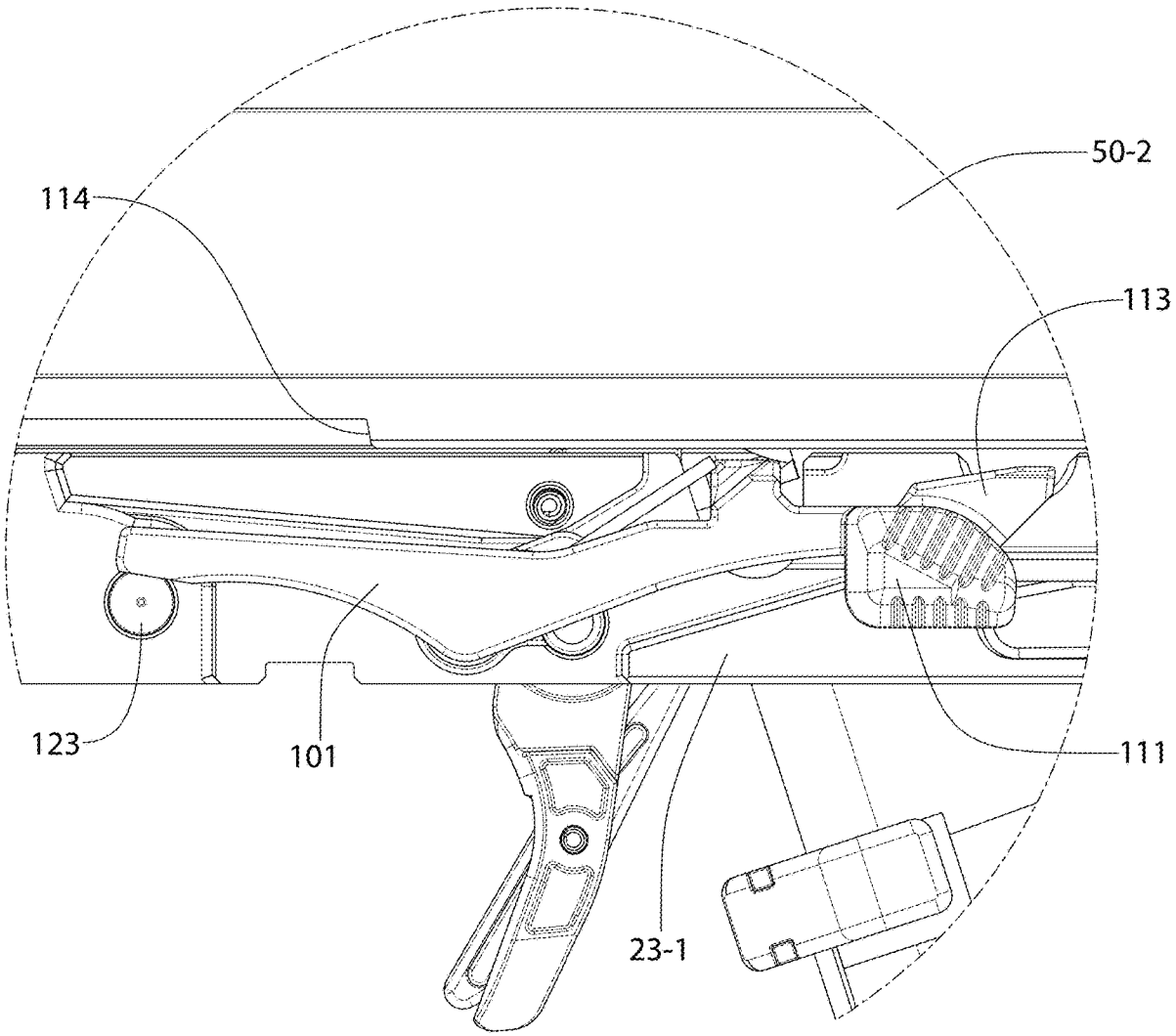
FIG. 9B is an enlarged detail taken from FIG. 9A.
Figure 13:
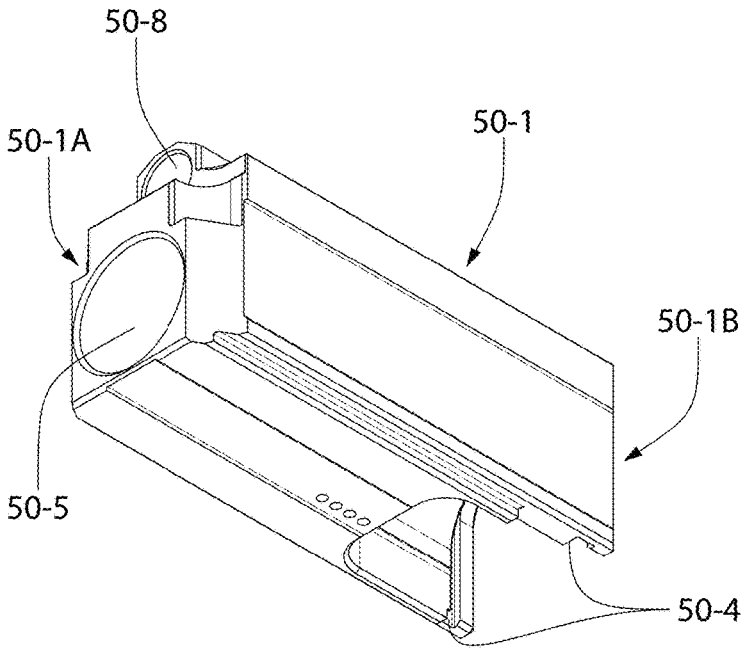
FIG. 13 is a bottom exploded perspective view of the bolt.
Figure 13:
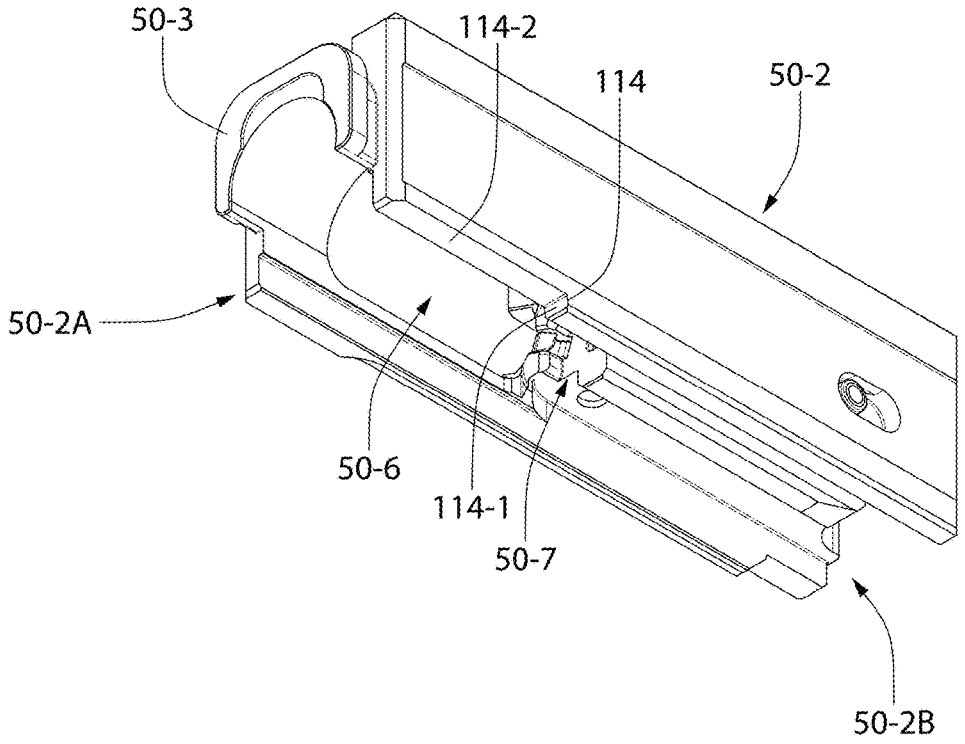
Figure 14:
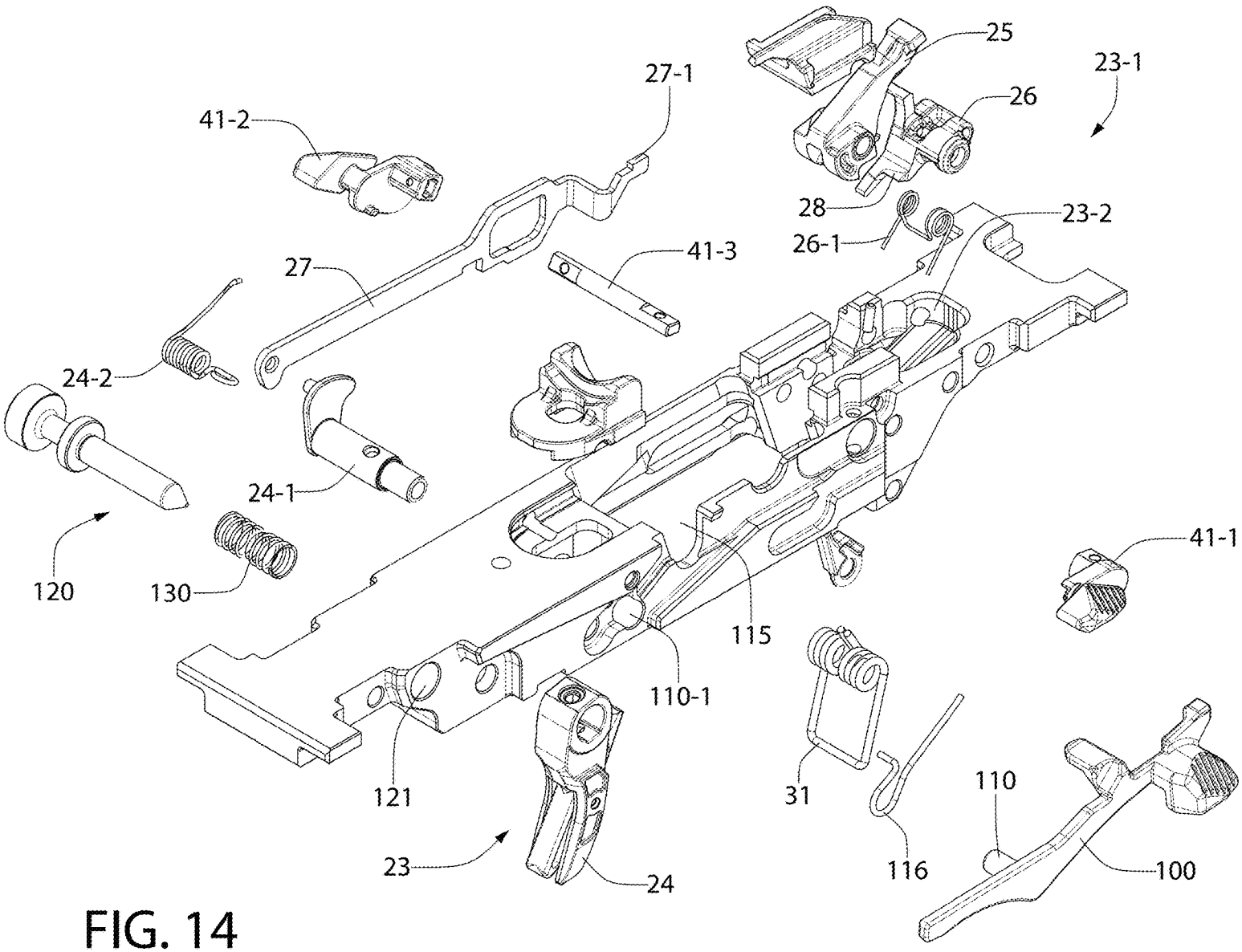
FIG. 14 is a top exploded perspective view of the fire control insert with firing mechanism components and the bolt catch mounted thereon.
Figure 15:
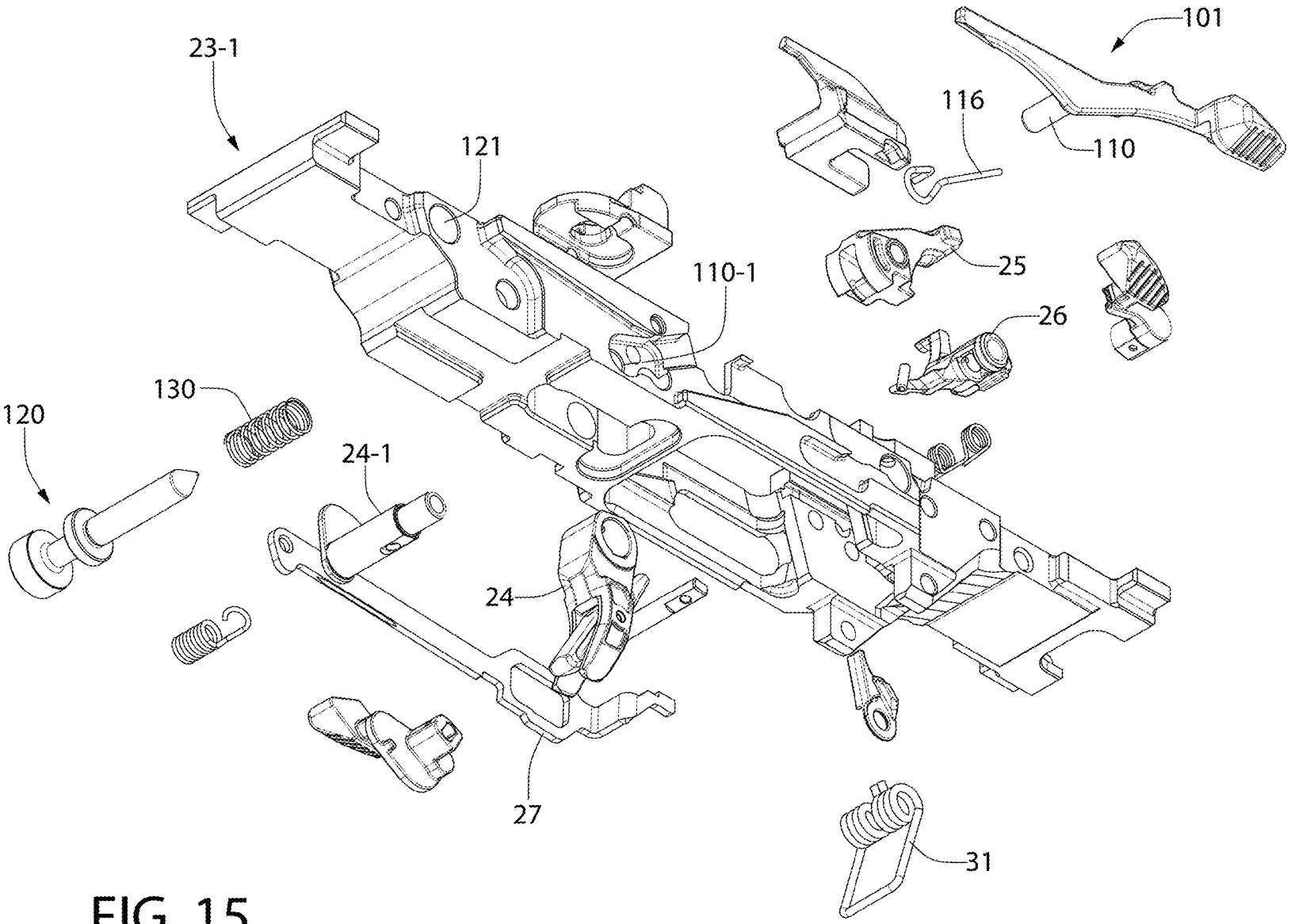
FIG. 15 is a bottom exploded perspective view thereof.
Figure 16:
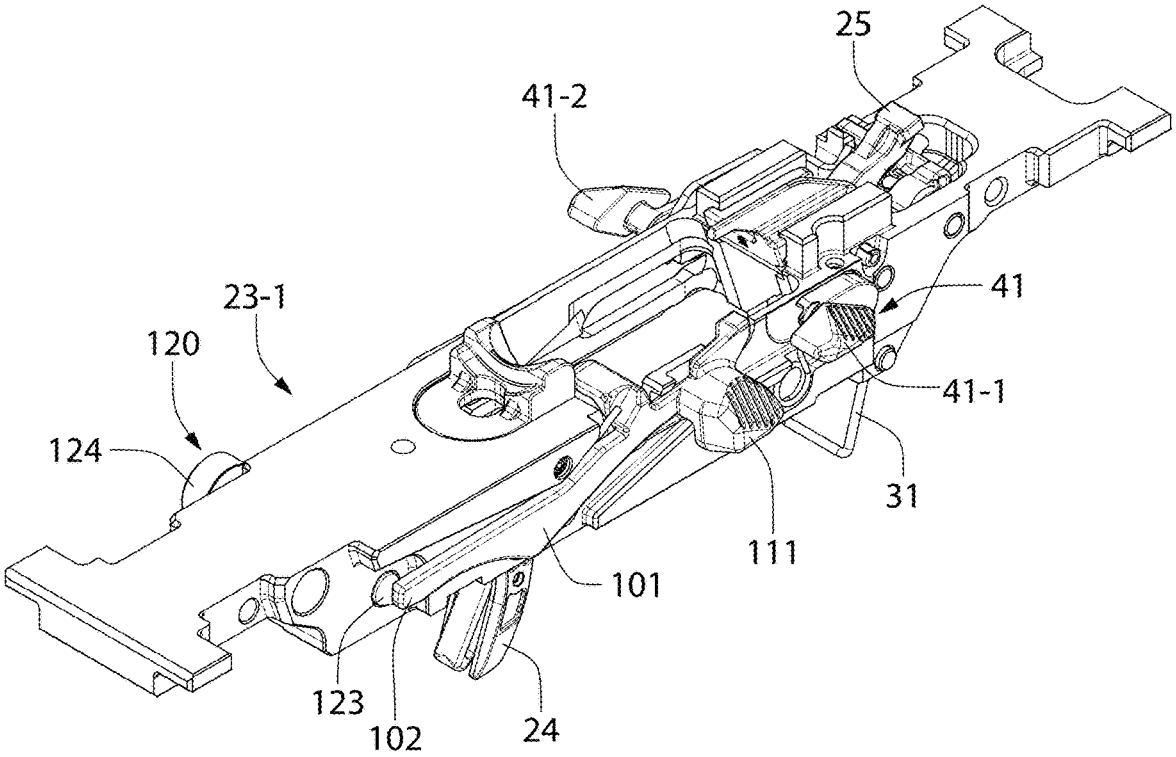
FIG. 16 is a top front assembled perspective view thereof.
Figure 17:
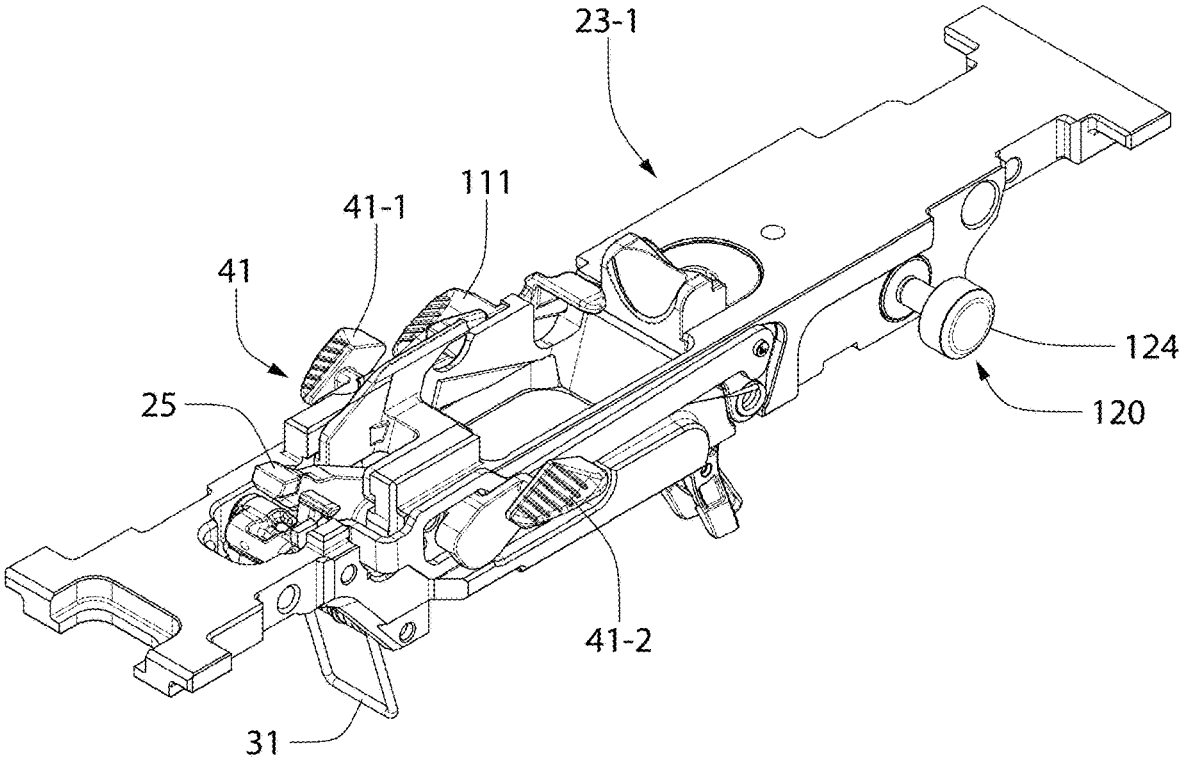
FIG. 17 is a first top rear assembled perspective view thereof.
Figure 18:
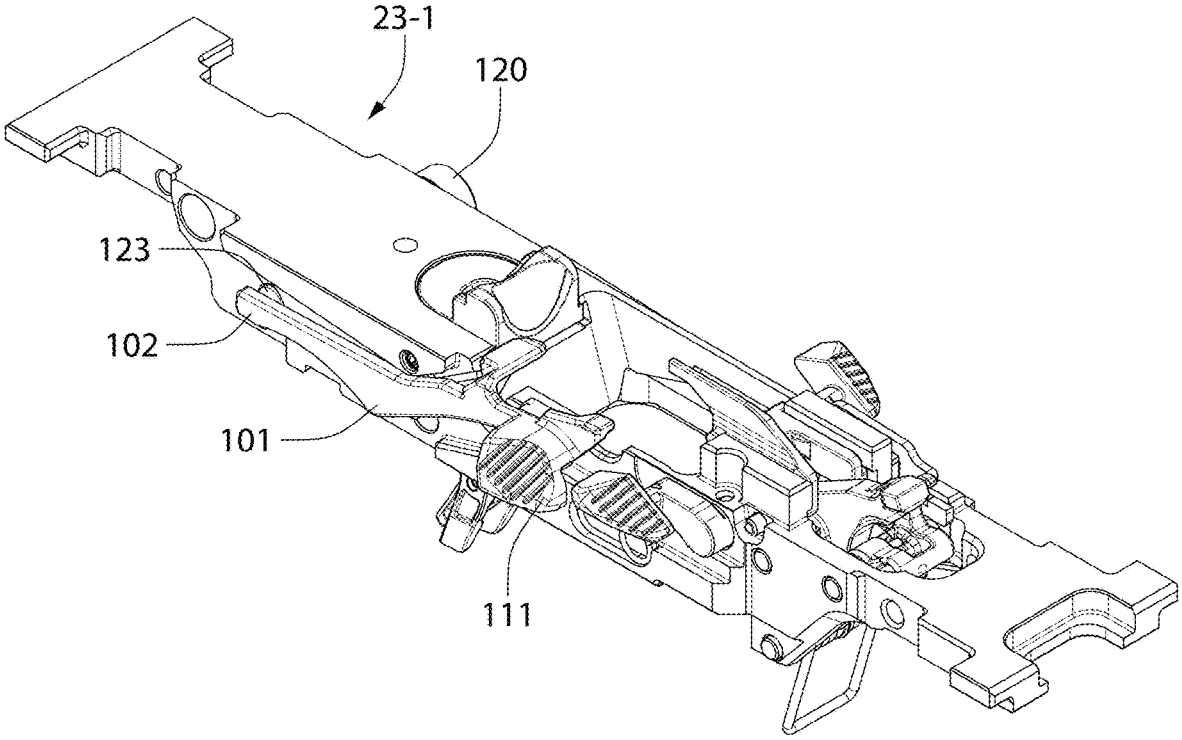
FIG. 18 is a second top rear assembled perspective view thereof.
Figure 19:
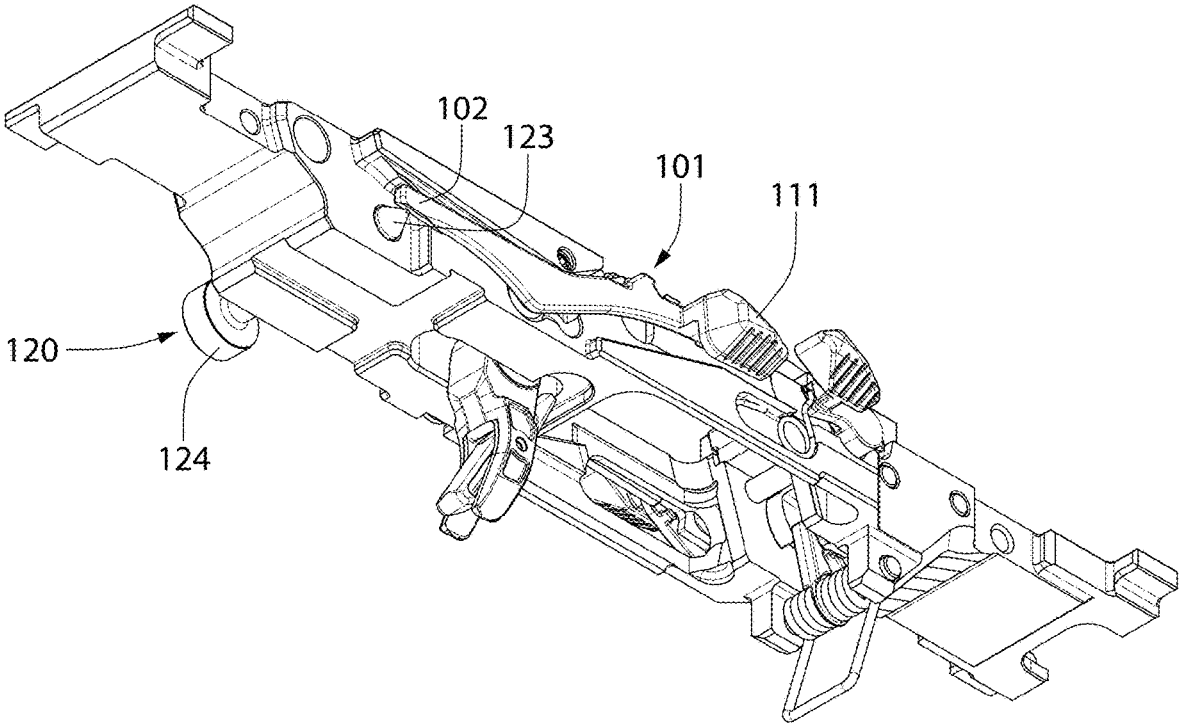
FIG. 19 is a bottom assembled perspective view thereof.
Figure 20:
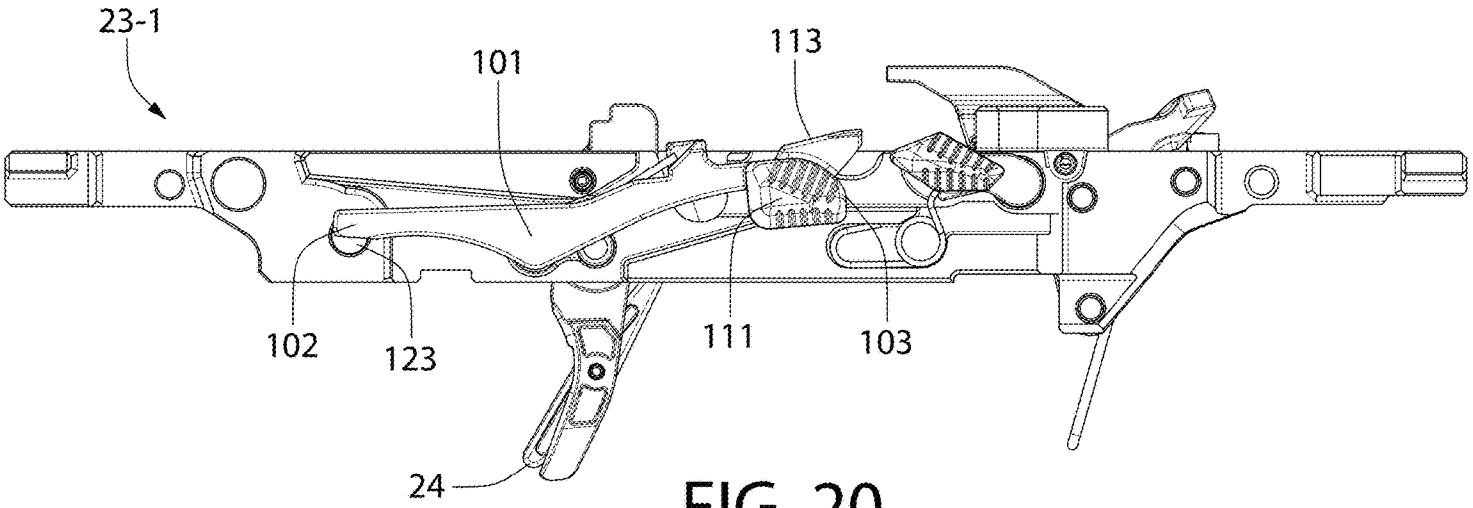
FIG. 20 is a left side view of the fire control insert.
Figure 21:
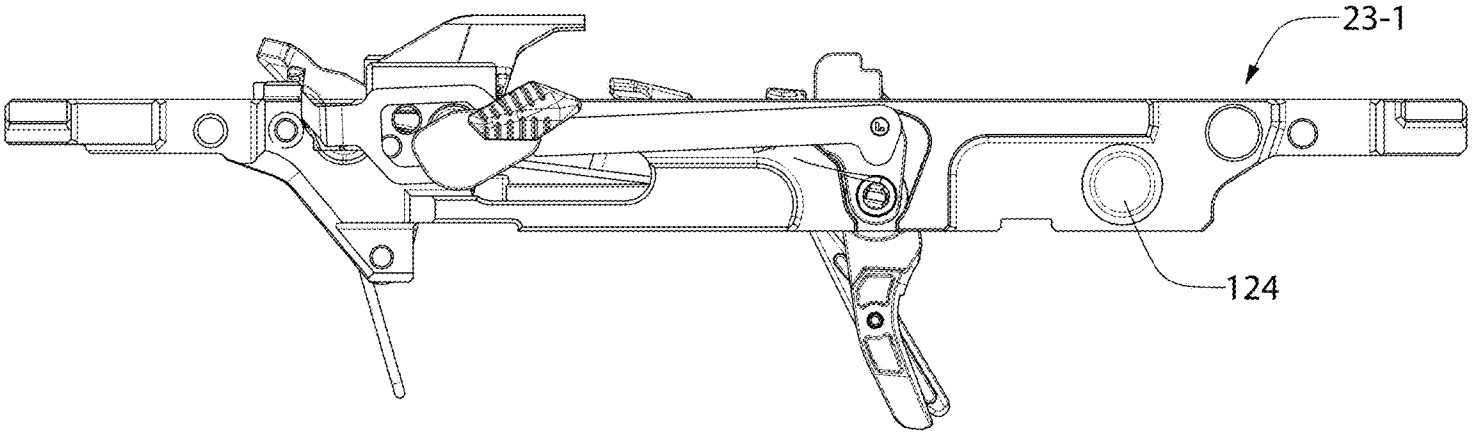
FIG. 21 is a right side view thereof.
Figure 22:
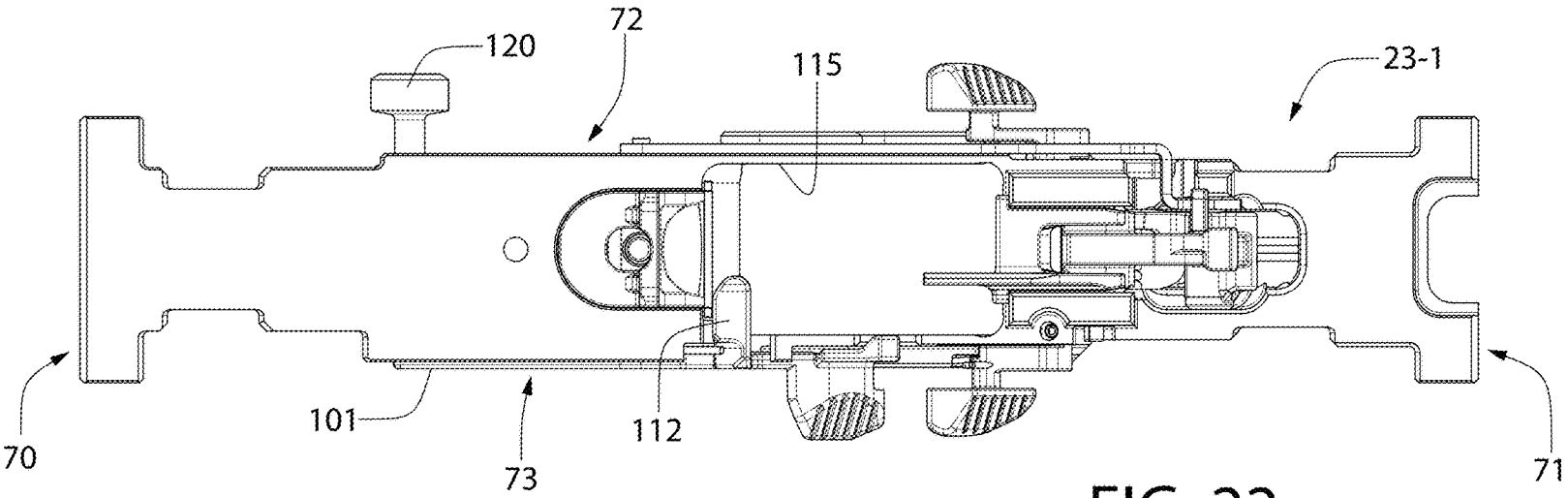
FIG. 22 is a top view thereof.
Figure 23:
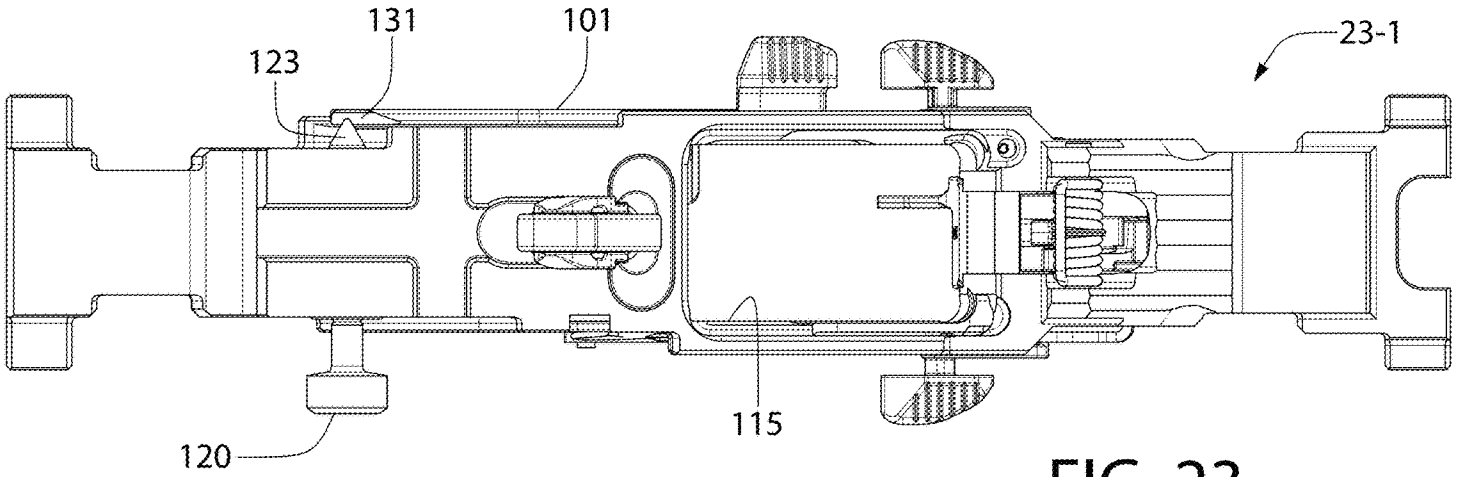
FIG. 23 is a bottom view thereof.
Figure 24:
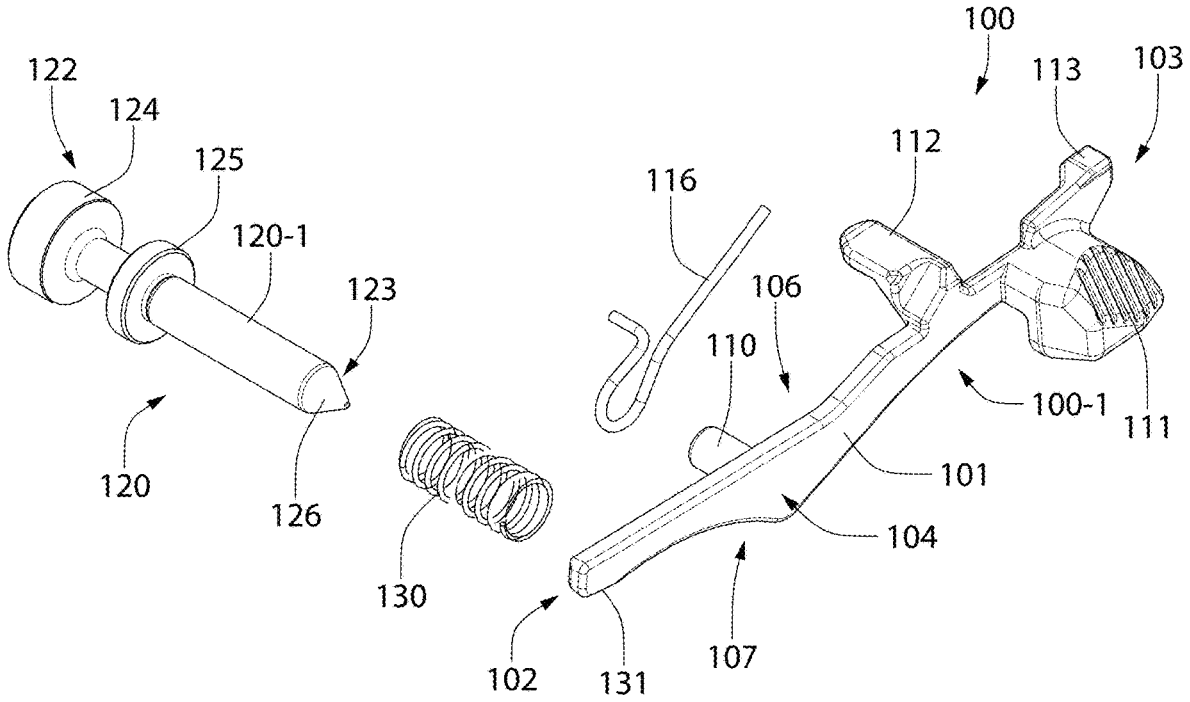
FIG. 24 is a first exploded perspective view of the bolt catch comprising the bolt catch lever and actuator plunger.
Figure 25:
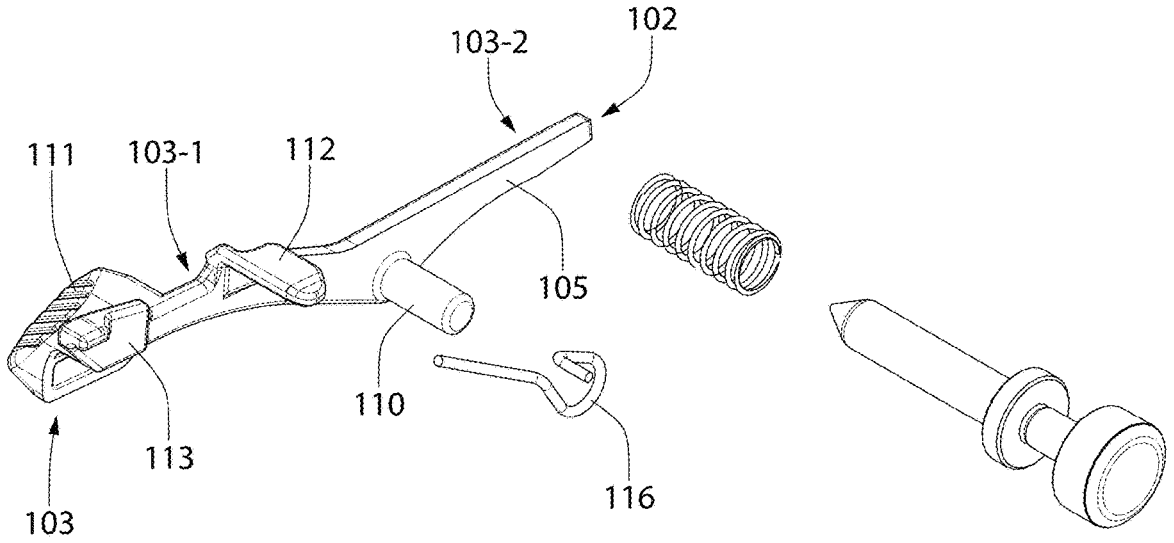
FIG. 25 is a second exploded perspective view thereof.
Figure 26:
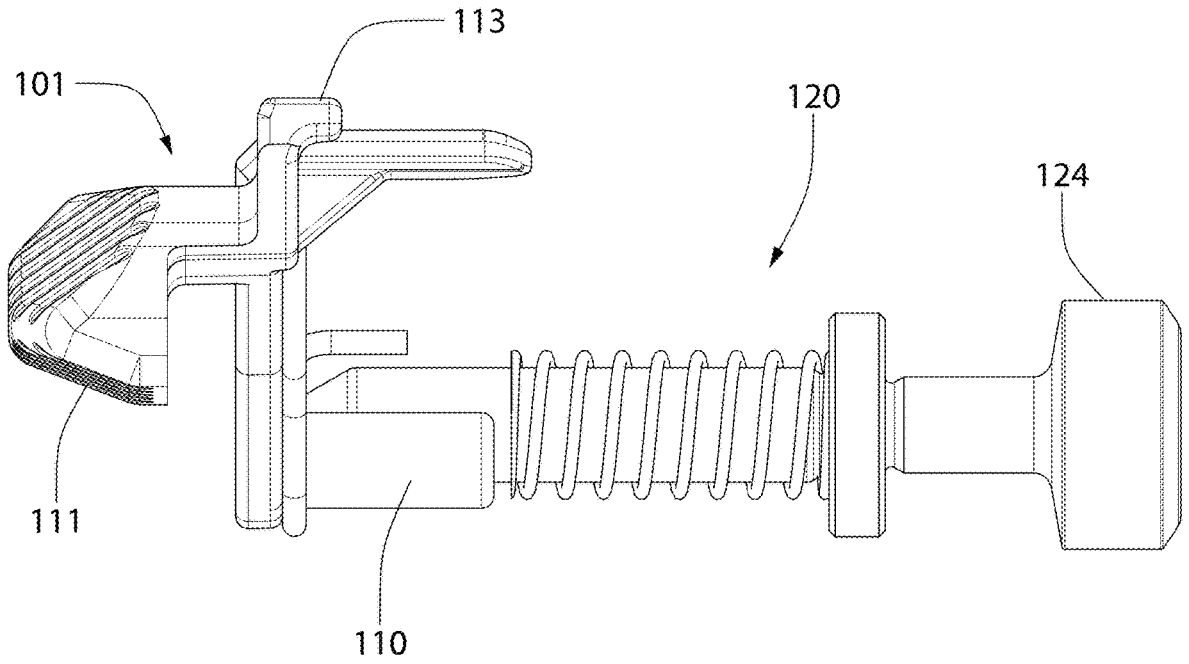
FIG. 26 is a rear view thereof in an assembled condition.
Figure 27:
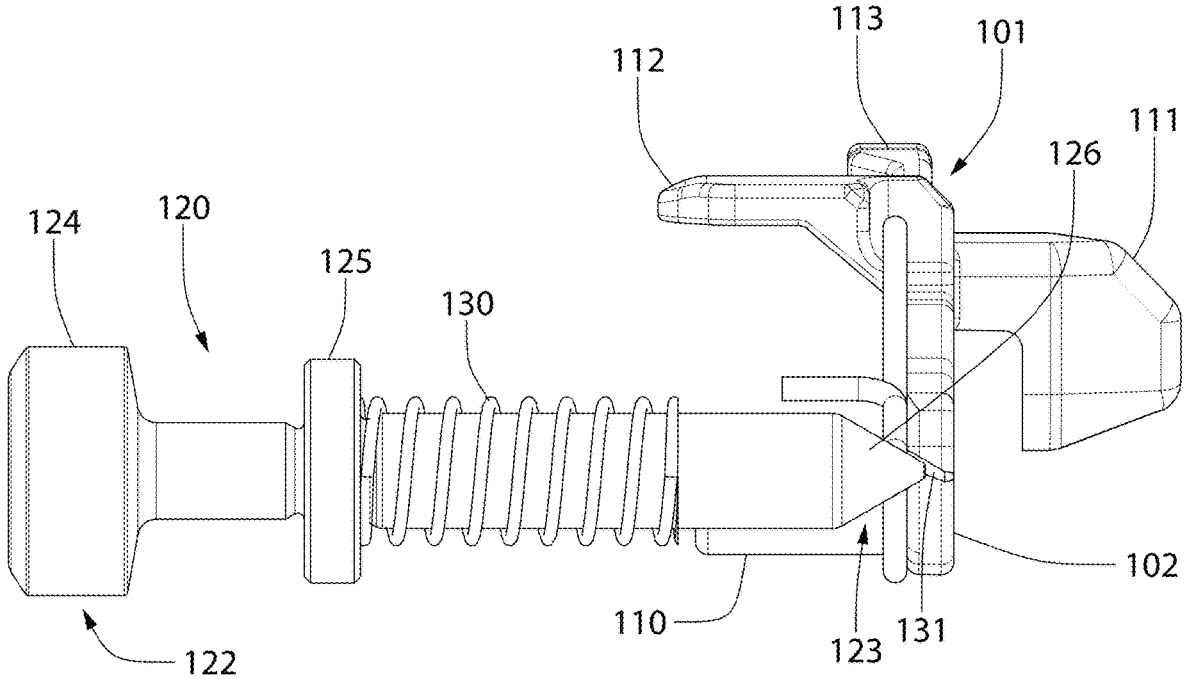
FIG. 27 is a front view thereof.
Figure 28:
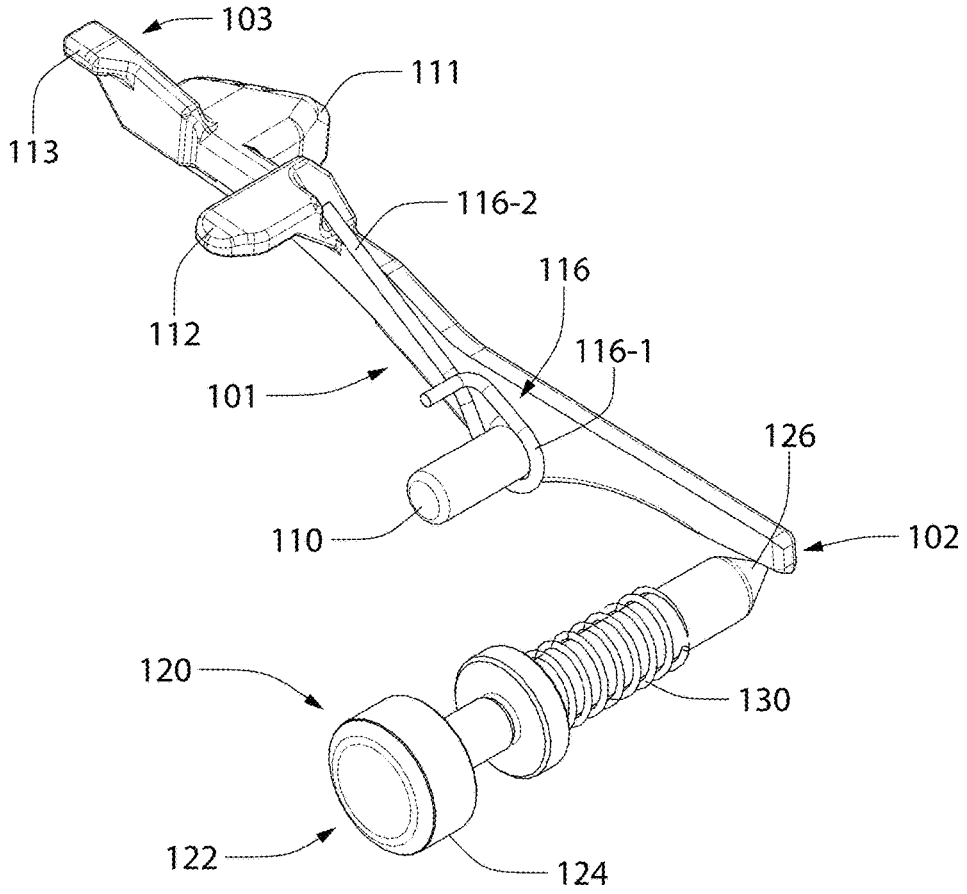
FIG. 28 is a top perspective view thereof.
Figure 29:
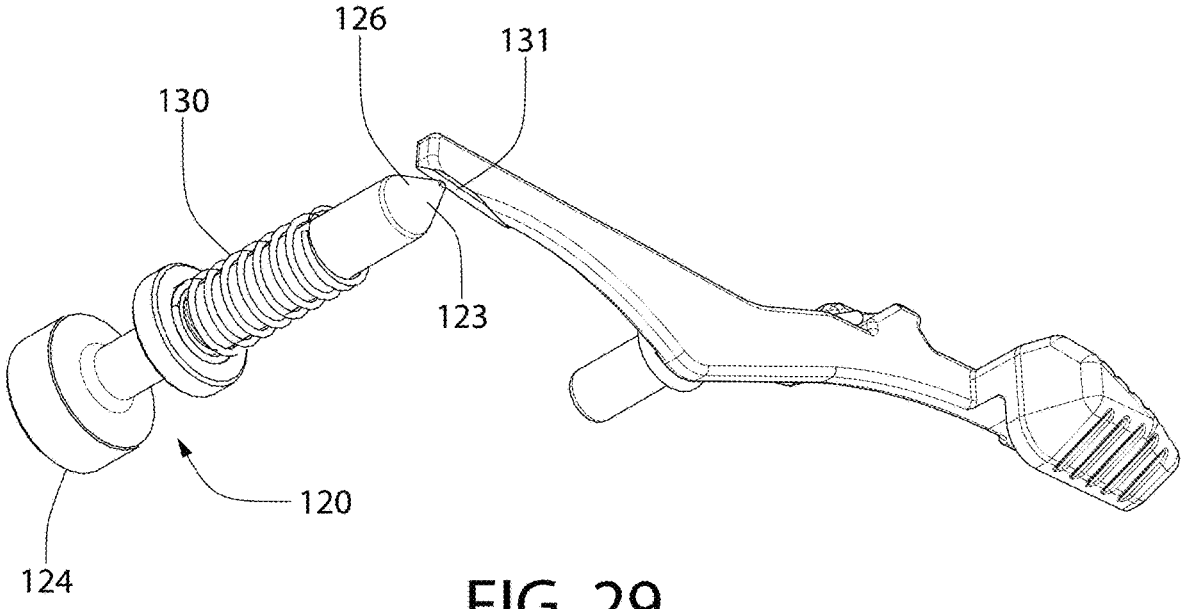
FIG. 29 is a bottom perspective view.
Figure 30:
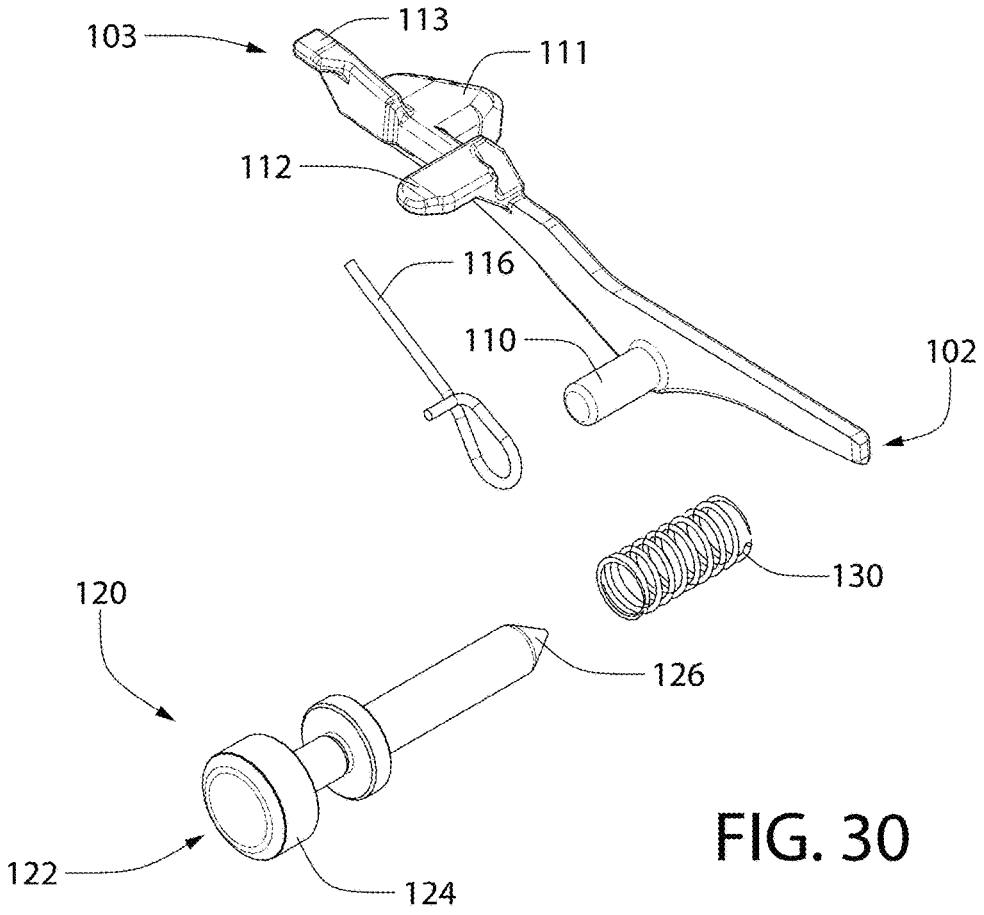
FIG. 30 is a third exploded perspective view thereof.

In one embodiment shown in FIGS. 8-9 and 13, locking ledge 114 may be formed on the underside of one of the lateral sides 58 of the bolt body. In the present embodiment, locking ledge 114 is formed on the bottom of the left lateral side of bolt 50. Locking ledge 114 defines a forward facing locking surface 114-1 which engages the bolt catch protrusion 113 when the bolt catch lever 101 is actuated and in its upward engaged position. Locking surface 114-1 may be formed at the rear end of a downwardly open longitudinal recess 114-2 formed forward of the locking surface on the bolt. In one embodiment, longitudinal recess 114-2 may be formed on the underside of the left lateral side of the bolt 50 and slideably receives the bolt catch protrusion 113 when the bolt catch protrusion is moved upwards with the rear end of the bolt catch lever as it pivots to its upward engaged position and the bolt is attempting to be returned forward by the recoil spring from the bolt's rear open breech position. Bolt catch protrusion 113 slides rearward in the recess until it meets and engages the locking ledge 114 and locking surface 114-1, which thereby retains the bolt in the rearward open breech position.

In one embodiment, the locking ledge 114 and longitudinal recess 114-2 may be formed on the rear bolt piece 50-2 for the two-piece bolt 50 construction. The locking ledge is positioned on the bolt relative to the bolt catch protrusion 113 of the bolt catch lever 101 to establish and retain the open breech until the bolt is manually released forward by the user via actuating handle 111 or actuator plunger 120.

Actuating handle 111 protrudes laterally/transversely outwards from exterior side 104 of the bolt catch lever 101 from the rear portion 103-1 of the lever defined between pivot pin 110 and rear end 103. The actuating handle may be disposed proximate to rear end 103 of the bolt catch lever 101, and in one embodiment may define the rear end. Actuating handle 111 may be disposed adjacent to and on the opposite side of the bolt catch protrusion 113 on the lever to maximize leverage about the pivot axis PA and range of vertical motion of the bolt catch protrusion to positively engage the bolt when actuated. The actuating handle may have any suitable configuration to enhance grasping by the user to manually actuate the bolt catch lever 101 for either engaging and locking the bolt 50 in its rearward open breech position, or disengaging and releasing the bolt forward. Handle 111 is pushed upward to engage the bolt, and pushed downwards by the user to disengage the bolt.

Follower engagement protrusion 112 of bolt catch lever 101, which is configured and arranged to be automatically engaged by follower 33-1 of the magazine 33 when empty, protrudes perpendicularly and laterally/transversely inwards in a horizontal direction from interior side 104 of the bolt catch lever 101. Follower engagement protrusion 112 may be disposed on the rear portion 103-1 of the lever defined between pivot pin 110 and rear end 103. The follower engagement protrusion may be located forward of actuating handle 111 on bolt catch lever 101 in one embodiment. Follower engagement protrusion 112 may have a transversely elongated and can have a generally flattened body in one embodiment.

With additional reference to FIGS. 14-23 as applicable, follower engagement protrusion 112 extends inwards into a central opening 115 of fire control insert 23-1 which is located directly above and communicates with magazine well 32 of the pistol grip frame 82-1. The follower engagement protrusion may be located proximate to the front of central opening 115 and magazine well 32 for engagement by the magazine follower 33-1 after the last cartridges has been dispensed from the magazine. The follower engagement protrusion therefore extends inwards into the central opening 115 by a sufficient distance to positively engage the magazine follower 33-1 when no rounds remain in the magazine.

After the last chambered round (cartridge) is fired from the magazine 33, the magazine follower 33-1 forced upwards by magazine spring 33-2 will protrude up into the breech area of receiver 21 from the top of the magazine to engage and force the follower engagement protrusion 112 of bolt catch lever 101 upwards. This pivots the rear end 103 of the bolt catch lever in turn about its pivot axis PA (defined by pivot pin 110) which moves from the downward disengaged position to the upward engaged position. This motion in turn raises the bolt catch protrusion 113 upward to engage the locking ledge 114 of the bolt as it attempts to return forward under the biasing action of recoil spring 54. The breech is therefore locked in the open position via automatic operation of the magazine follower 33-1 and follower engagement protrusion 112. To release the bolt, the user manually depresses actuating handle 111 downward as previously described herein, or alternatively uses actuator plunger 120.

Catch spring 116 is configured and operable to bias bolt catch lever 101 towards it downward disengaged position to prevent interference with cycling of bolt 50 rearward and forward under normal operation of the firearm when firing until the bolt catch lever is activated. The catch spring 116 may be a torsion spring in one embodiment which is mounted about pivot pin 110. Spring 116 may comprise a rear partial coil section 116-1 which engages and partially wraps around the pivot pin and a forward extending leg 116-2 which acts downward on magazine-operated follower engagement protrusion 112 to bias the bolt catch lever downwards (see, e.g., FIG. 28). Other types of springs and arrangements may be used to provide the desired biasing operation.

Actuator plunger 120 provides manual ambidextrous operation of the bolt-catch release mechanism from the opposite side of the firearm on which the bolt catch lever 101 is disposed. Specially, the actuator plunger when depressed is therefore configured and operable to engage and actuate the bolt catch lever, thereby causing the lever to disengage and release the bolt 50 when locked rearward by the bolt catch without use of the actuating handle 111 on the bolt catch lever.

Referring generally to FIGS. 24-33, the manually depressible spring-biased actuator plunger 120 may be transversely mounted in the firearm relative to the longitudinal axis LA (e.g., perpendicularly) and extends through the firearm from one lateral side 21-1 (e.g., right side) to the opposite lateral side 21-2. In one embodiment, plunger 120 may be transversely mounted to and slideably received through a laterally open transverse mounting passage 121 formed through the front portion of fire control insert 23-1 from side to side (see also FIGS. 14-23).

Figure 32:
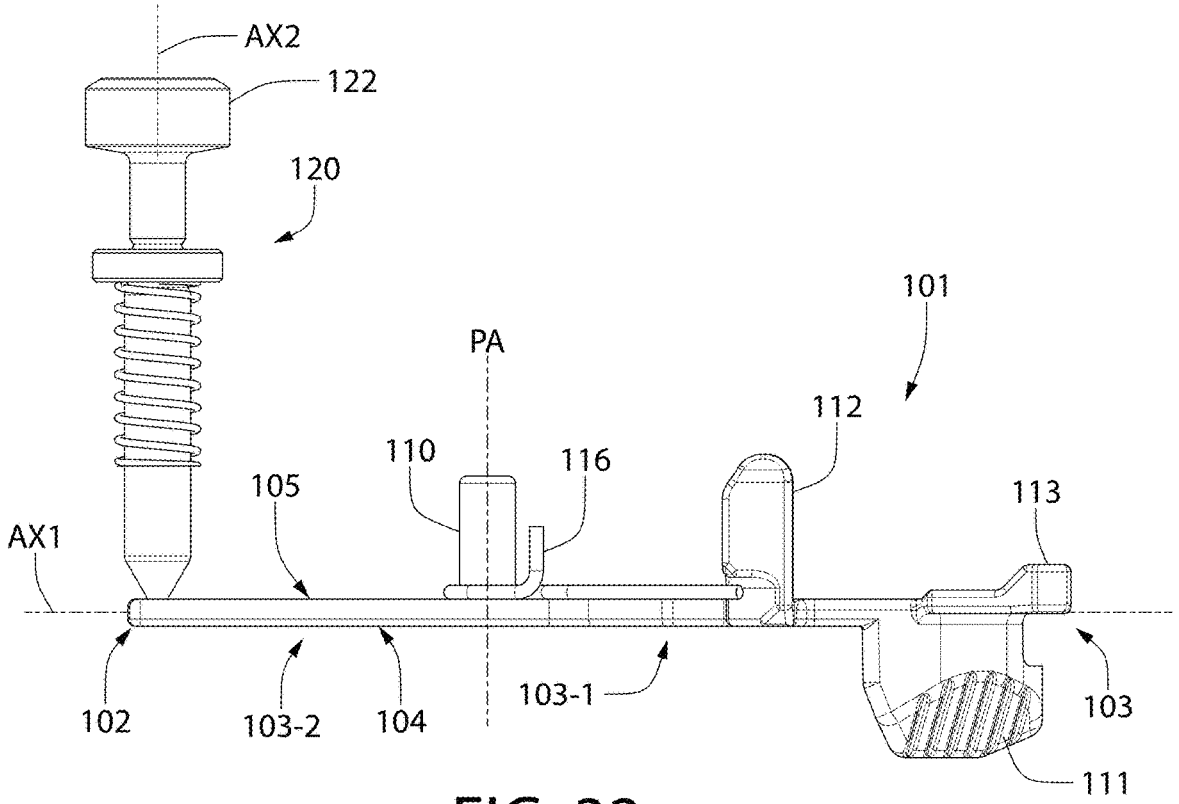
FIG. 32 is a top view thereof in an assembled condition.
Figure 33:
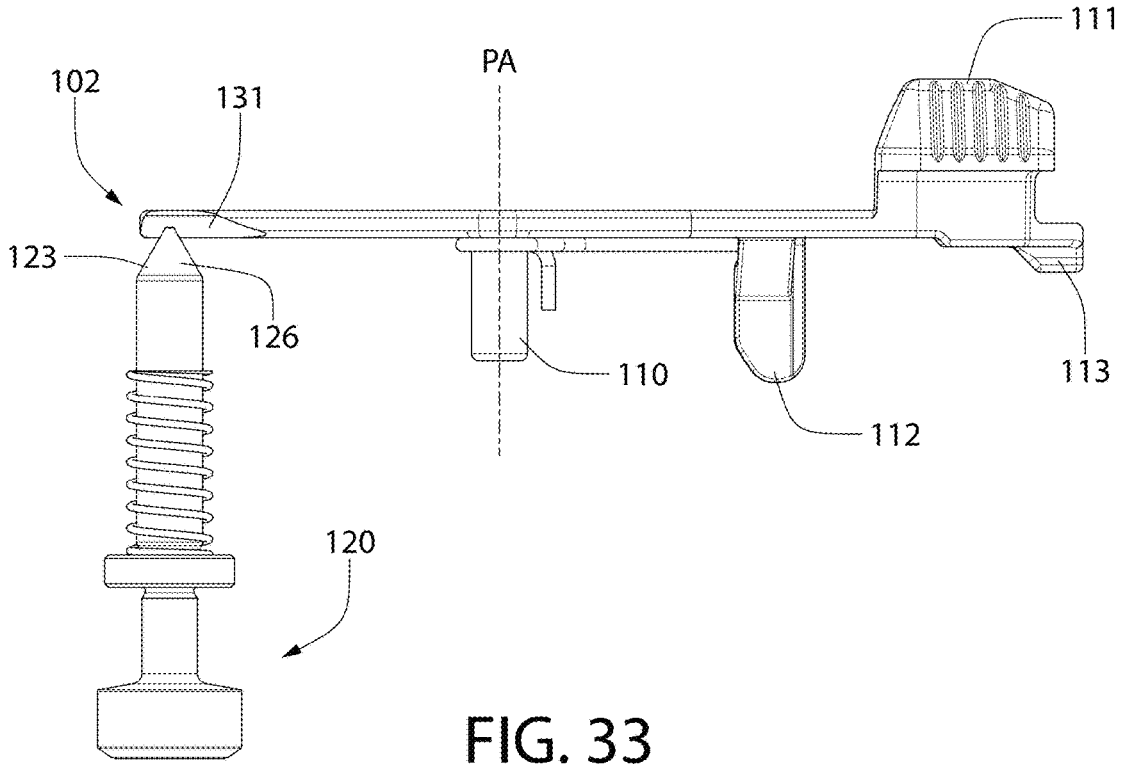
FIG. 33 is a bottom view thereof.

As shown in FIG. 32, actuator plunger 120 is oriented perpendicularly to the bolt catch lever 101. The elongated body of bolt catch lever 101 defines a lever axis AX1 and plunger 120 defines a plunger axis AX2 which is oriented perpendicularly to the lever axis. Plunger 120 operably interacts with the front portion 103-2 of bolt catch lever 101, and in a preferred but non-limiting embodiment shown engages the lever proximate to the front end 102 thereof, as further described herein.

Actuator plunger 120 is slideably moveable transverse to the longitudinal axis LA of the firearm between (1) an actuated position engaged with the bolt catch lever 101 (see, e.g., FIG. 11), and (2) an unactuated position (see, e.g., FIG. 10) disengaged from the bolt catch lever to avoid interference with operation of the lever when actuated manually via actuating handle 111 or magazine-operated follower engagement protrusion 112. In the "engaged" position, the plunger 120 actively displace and pivots the bolt catch lever 101 about its pivot axis PA to activate the bolt stop function. In the "disengaged" position, the plunger does not engage altogether or does not sufficiently engage the bolt catch lever to the degree necessary to impart motion to and actuation of the bolt catch lever to release the bolt (although some minor contact between these parts may exist). The actuator plunger 120 converts sliding linear motion of the plunger into rotational/pivoting motion of the bolt catch lever 101 about its pivot axis PA.

In one embodiment, actuator plunger 120 comprises a generally cylindrical body 120-1 comprising an externally exposed operating end 122 configured for operating the plunger by the user, and an opposite working end 123 configured to selectively engage and rotate the bolt catch lever when the plunger is actuated. Operating end 122 may be diametrically enlarged in one embodiment defining an enlarged circular head 124 which protrudes outwards to facilitate ease of operation by the user for depressing the plunger towards the bolt catch lever 101. In other embodiments, the operating end may not be diametrically enlarged.

Plunger spring 130 biases the plunger 120 towards the unactuated position "operably" disengaged from the bolt catch lever 101 as explained above. Spring 130 may be a helical compression spring in one embodiment which is disposed inside the transverse mounting passage 121 of fire control insert 23-1 and coiled around the plunger body (see, e.g., FIGS. 10-11). In one embodiment, plunger 120 includes diametrically enlarged travel stop flange 125 which is selectively engageable with a pair of opposing travel stop surfaces 131 and 132 formed inside mounting passage 121. The flange 125 may be slideably disposed inside a corresponding diametrically enlarged chamber 133 of the mounting passage which defines stop surfaces 131, 132 at opposite sides thereof as shown. Travel stop flange 125 abuttingly engages travel stop surface 131 when the plunger is not actuated (i.e. depressed inwards by the user). When the user depresses plunger 120, the stop flange engages the opposite travel stop surface 132. The travel stop flange and stop surfaces limit the lateral/transverse range of motion of the plunger 120.

The working end 123 of actuator plunger 120 is configured to operably interact with and impart motion to the bolt catch lever 101 to disengage and release bolt in the manner previously described herein when the plunger is depressed inwards by the user towards the lever. In one embodiment, the user applies a non-rotating inward linear force F as shown in FIG. 11 to the operating end 122 (e.g., enlarged circular head 124) of the plunger. This slides the plunger transversely and perpendicularly towards bolt catch lever 101. Mutually engaged sliding surfaces of the plunger and bolt catch lever respectively operably cooperate to actuate and rotate the bolt catch lever. It bears noting that there is no abutting engagement between the plunger and bolt catch lever when the plunger is depressed and actuated which would force the lever laterally outwards from the firearm. Instead, a lifting motion is applied to the front end 102 of bolt catch lever 101 by the actuator plunger 120 via a pair of mating inclined surfaces 126, 131 which slide relative to each other, as described below.

With continuing reference to FIGS. 24-33 and also FIGS. 10-11, working end 123 of actuator plunger 120 includes an inclined camming surface 126 which slideably engages a corresponding inclined camming ramp 131 formed on the bolt catch lever 101 to pivot the bolt catch lever from the engaged position to the disengaged position when the actuator plunger is depressed and actuated. In one embodiment, the plunger working end 123 may have a configuration forming a conically shaped tip which defines a circumferential continuum of inclined camming surfaces 126 on the working end having the same angle of inclination or slope. With this conical tip design, any slight rotation of the cylindrical-bodied plunger about its plunger axis AX2 which might possibly occur when the user pushes the plunger inwards will advantageously ensure that inclined camming surface 126 is always properly oriented with respect to the inclined camming ramp 131 on bolt catch lever 101 to ensure reliable operation of the bolt-catch release mechanism. This design also obviates any need for anti-rotation features to be incorporated into the plunger mechanism to ensure proper alignment and orientation of the plunger camming surface 126 with the bolt catch lever camming ramp 131.

In other possible embodiments contemplated, however, actuator plunger 120 may have a non-cylindrically shaped body and/or may include anti-rotation features if provided with a single inclined camming surface on the plunger working end 123 of fixed orientation rather than a conical tip.

It bears noting that in yet other possible embodiments, only one inclined surface such as camming surface 126 on plunger 120 or the camming ramp 131 bolt catch lever 102.

The inclined camming ramp 131 on bolt catch lever 101 may be disposed on a front portion 103-2 of the bolt catch lever forward of the pivot axis PA. In one embodiment, camming ramp 131 may be formed on the underside/bottom of the front end 102 of the bolt catch lever near the tip. This advantageously maximizes the length of the lever arm between the camming ramp and pivot axis PA in the middle section of the lever (formed by pivot pin 110 which acts as a fulcrum) so that raising the front end of the bolt catch lever via operation of actuator plunger 120 concomitantly lowers the bolt catch protrusion 113 formed on rear end 103 of the lever with sufficient force to ensure positive disengagement with and release of the spring-biased bolt 50 forward.

Figure 31:
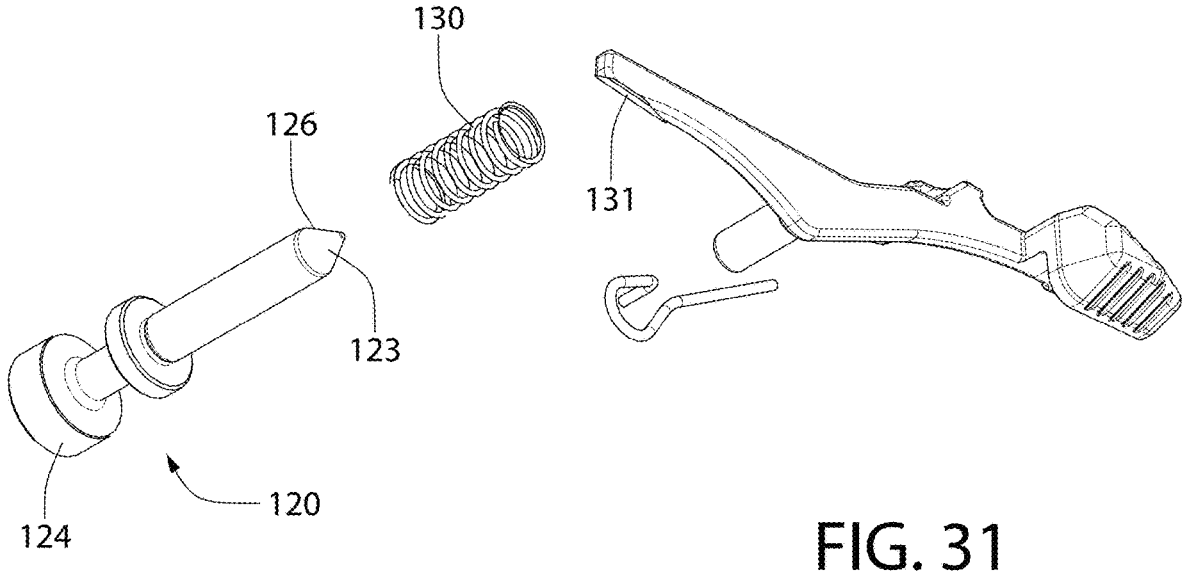
FIG. 31 is a fourth exploded perspective view thereof.

In one embodiment, with reference to FIGS. 10-11 and 31, the inclined camming ramp 131 of bolt catch lever 101 may slope in the lateral direction of the plunger axis AX1 and a transverse to both vertical reference plane VP of the bolt catch lever and longitudinal axis LA of the firearm. The low point on the ramp is therefore toward and adjacent the exterior side 104 of bolt catch lever 101, while the high point is adjacent the interior side 105 of the bolt catch lever. Inclined camming surface 126 of the plunger 120 is sloped in a similar direction and orientation with the low point on the surface being adjacent to the end of the pointed conical tip of the working end 123 of the plunger. The inclined camming surface 126 and ramp 131 have complementary angles of inclination so that a flat-to-flat sliding interface is formed therebetween in operation of the plunger to raise the front end 102 of bolt catch lever 101 and rotate the rear end 103 of the lever downwards about pivot pin 110. Accordingly, actuator plunger is operable to slideably engage the bolt catch lever when the user actuates the plunger.

In other possible alternative embodiments, the inclined camming ramp 131 of bolt catch lever 101 may alternatively be sloped in the axial/longitudinal direction on the underside of the lever front end 102 (i.e. front to rear of the lever) to engage the camming surface 126 formed on the pointed conical tip of the plunger working end 123. Wedging action imparted to the bolt catch lever by actuator plunger 120 which operates to rotate the lever between its engaged and disengaged positions as previously described herein would function in the same way.

Bolt catch lever 101 and actuator plunger 120 preferably may each be formed of a suitable metallic material such as steel, aluminum, titanium, or other. Bolt catch lever 101 in one non-limiting embodiment may have a one-piece monolithic unitary structure in one embodiment wherein each of the foregoing operating features 110-113 previously described herein are formed as integral parts thereof. Plunger 120 may have a similar one-piece monolithic unitary structure.

A process or method for operating bolt catch 100 of a firearm 20 will now be briefly described with reference to the figures. The firearm may begin in a ready-to-fire position with a closed breech shown in FIG. 3. Bolt 50 is in battery with the rear breech end of the barrel 22 under the forward biasing action of recoil spring 54. The bolt catch lever 101 of the bolt catch in the normal downward and lower disengaged position from bolt 50 under the biasing action of catch spring 116. Accordingly, bolt catch protrusion 113 is not projected upward to engage the bolt which would might interfere with normal cycling of the action (e.g., bolt 50) forward and rearward when discharging the firearm.

Operation of the bolt catch 100 starts with first moving bolt 50 from the forward closed breech position in battery with the barrel to the rearward open breech position (see, e.g., FIG. 8A). This can be performed either manually by the user pulling rearward on charging handle 51 to retract the bolt, or automatically via discharging with firearm which automatically moves the bolt rearward under recoil or other means such as a gas system.

With the bolt in the rearward open breech position, the method continues with engaging the bolt catch lever 101 with the bolt 50 to hold the bolt rearward. Specially, this involves rotating bolt catch protrusion 113 on lever 101 upwards about the lever pivot axis PA in a first direction to engage locking ledge 114 on the bolt. This can performed manually by the user pushing actuating handle 111 upwards to engage bolt catch protrusion 113 with the bolt, or automatically via operation of the last round bolt "hold open" feature previously described herein (i.e. magazine follower 33-1 engaging and forcing the follower engagement protrusion 112 of bolt catch lever 101 upwards to engage the bolt catch protrusion with the bolt). Either operating scenario results in the bolt 50 being locked and held rearward with an open breech.

To release the bolt 50 from the side of the firearm opposite the bolt catch lever, the method continues with the user pushing and sliding the actuator plunger 120 in a laterally inwards transverse direction towards to the bolt catch lever 101 from an unactuated position to an actuated position. This results in slideably engaging inclined camming surface 126 on the actuator plunger 120 with an inclined camming ramp 131 on the bolt catch lever, thereby rotating the bolt catch lever about the pivot axis PA in a second direction which disengages and releases the bolt from the open breech position. Specifically, "wedging" action applied to the underside of the front end 102 of the bolt catch lever via mutual sliding engagement between the inclined camming surface and ramp raises the lever front end and correspondingly forces the opposite rear end 103 downwards about pivot axis PA to disengage the bolt catch protrusion 113 from locking ledge 114 on bolt 50, thereby returning the bolt forward to reclose the breech via the biasing action of recoil spring 54 previously described herein.

Although bolt catch lever 101 is illustrated and described herein as being located on the left side of the firearm (i.e. left lateral side 21-2 of receiver 21) and the operating end 122 (e.g., enlarged head 124) of actuator plunger 120 is on the right lateral side 21-1, these locations may be reversed in other embodiments provided the locking ledge 144 of bolt 50 is provided on the opposite side from that illustrated to allow the bolt catch to lock the bolt rearward. Accordingly, the invention is not limited to either arrangement which will function the same as described herein.

Figure 34A:
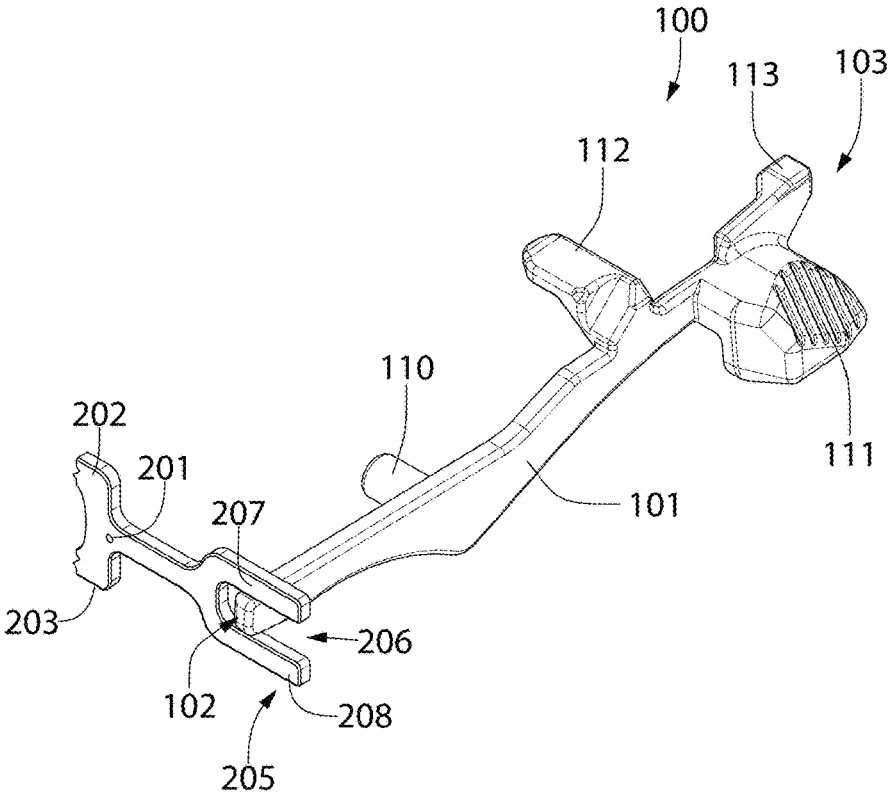
FIG. 34A is a schematic diagram of a first alternative embodiment of a bolt catch showing a dual acting pivotably movable bolt catch operating lever.
Figure 34B:
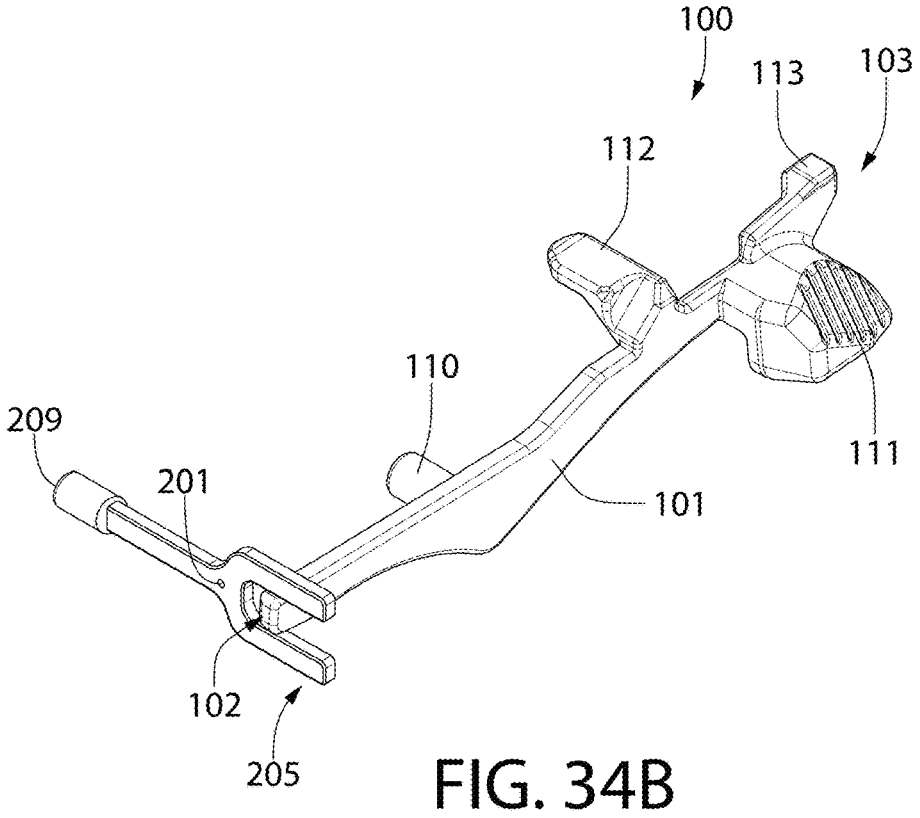
FIG. 34B is a schematic diagram of a second alternative embodiment of a bolt catch showing a dual acting pivotably movable bolt catch operating lever.

FIGS. 34A and 34B depict alternative embodiments of the bolt catch. Bolt catch lever 101 may be configured similarly to the catch lever previously described herein. Linearly slideable actuator plunger 120 however is replaced with a pivoting bolt catch operating lever 200A or 200B with operating end disposed on the side of the firearm opposite the bolt catch lever as shown. Operating levers 200A and 200B are transversely oriented and configured to engage and operate the bolt catch lever 101 on the opposite lateral side of the firearm via a toggle action as shown. Both levers 200A and 200 B are dual-acting operating levers configured and operable to move the bolt catch lever between both the engaged and disengaged positions, as further described below.

FIG. 34A shows one embodiment of dual-acting bolt catch operating lever 200A which is configured for pivoting about a pivot pin 201 between alternate positions via pressing inwards on a pair of upper and lower operating tabs or buttons 202, 203 disposed on the operating end 204 of the lever. Pivot pin 201 defines a pivot axis of the bolt catch operating lever which is axially oriented in a longitudinal direction along the longitudinal axis LA of the firearm. The pivot pin may be mounted to any suitable portion of the receiver and/or stock of the firearm. Upper button 202 is disposed above the pivot axis, whereas lower button 203 is disposed below the pivot axis. Neither button is aligned with the pivot axis so that a moment force is created when the buttons are alternatingly pushed thereby creating the toggle action of the bolt catch operating lever. Pushing the upper button 202 inwards rotates the working end 205 of the bolt catch operating lever 200A downwards to move the bolt catch lever 101 from the disengaged position to the engaged position to lock the bolt back. Alternatively, pushing the lower button 203 inwards rotates the working end of the bolt catch operating lever upwards to move the bolt catch lever from the engaged position to the disengaged position to release the bolt forward.

The opposite working end 205 of the bolt catch operating lever 200A may be forked shaped (i.e. forked working end) as shown defining an opening 206 between upper and lower prongs 207, 208 which receives the front end 102 of bolt catch lever 101 therein. To describe the toggle action of bolt catch operating lever 200A in more detail, pressing inwards on upper operating button 202 rotates the forked working end 205 downwards to in turn force the front end 102 bolt catch lever 101 downwards. This concomitantly rotates the bolt catch protrusion 113 on rear end 103 of the bolt catch lever upwards to engage the bolt 50. Conversely, pressing inwards on lower operating button 203 instead rotates the forked working end 205 upwards to in turn force the front end 102 bolt catch lever 101 upwards. This concomitantly rotates the bolt catch protrusion 113 on rear end 103 of the bolt catch lever downwards to disengage and release the bolt 50.

FIG. 34B shows another embodiment of dual-action bolt catch operating lever 200B which is substantially similar to operating lever 200A in construction and operation. However, the operating lever 200B is configured with a laterally outward projecting operating handle 209 that can be toggled up/down by the user to change position of the bolt catch lever 101 (in contrast to inward-activated push buttons 202, 203 on operating lever 200A). The embodiment in FIG. 34B functions in the same manner and includes the same forked operating end 205 providing a dual action operating lever which can either raise or lower the bolt catch lever 101 as described above.

In the embodiments of bolt catch operating lever 200A or 200B, it should be noted that the inclined ramp 131 of the bolt catch lever 101 can optionally be omitted because there is no sliding interface necessary unlike the plunger embodiment of the bolt catch lever previously described herein.

Figure 35A:
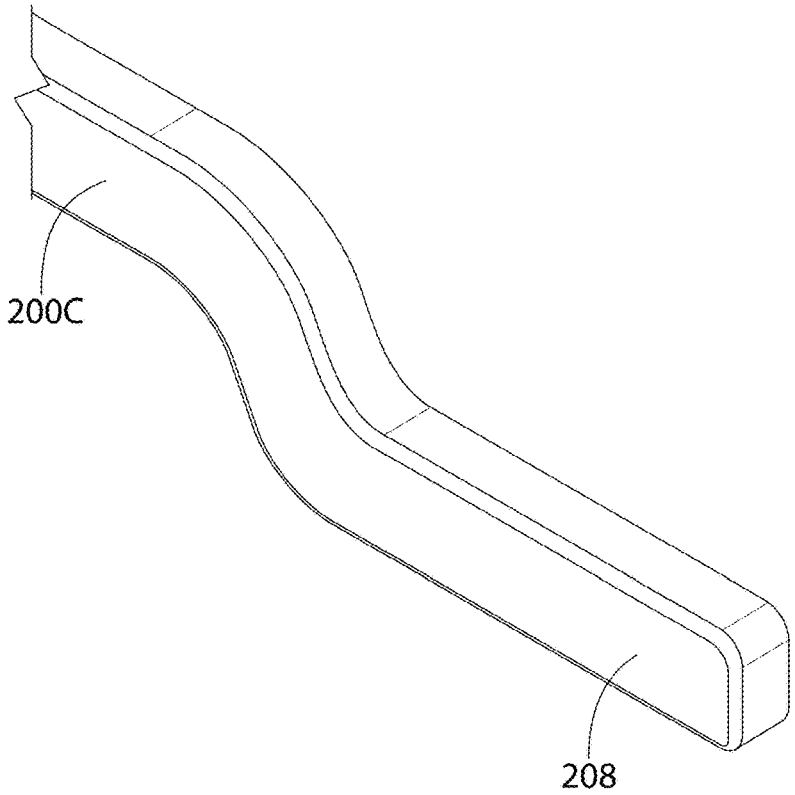
FIG. 35A is a schematic diagram of a first alternate embodiment of the working end of the bolt catch operating lever of FIGS. 34A or 34B.
Figure 35B:
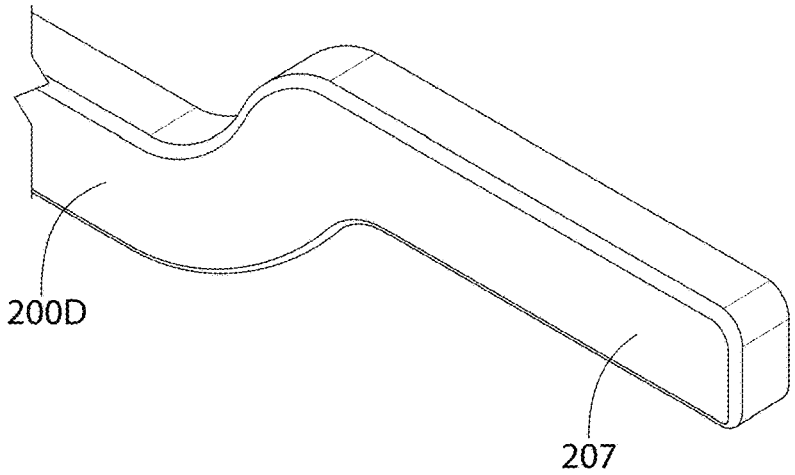
FIG. 35B is a schematic diagram of a second alternate embodiment of the working end of the bolt catch operating lever of FIGS. 34A or 34B.

As also shown, not all embodiments of bolt catch operating lever 200A or 200B need have a forked operating end if dual-action operation of the operating lever (i.e. the ability to toggle the bolt catch lever 100 alternatingly between both the engaged and disengaged positions) is not desired. Accordingly, a single lower prong 208 or upper prong 208 may be provided as shown in FIGS. 35A and 35B, which can be configured to either raise the front end of the bolt catch lever 101 to disengage the bolt catch protrusion 113 from the bolt 50, or to lower the front end of the bolt catch lever to engage the bolt catch protrusion with the bolt, respectively. The single lower prong 208 design provides a bolt release, whereas the single upper prong 209 design provides a bolt catch.

It bears noting that other configurations of working ends for either dual-acting or single-acting bolt catch operating levers may be provided.

In all of the foregoing configurations and embodiments of the bolt catch operating lever, the bolt catch lever 101 pivots in a first vertical reference plane parallel to the longitudinal axis LA of the firearm, whereas any of the bolt catch operating levers 200A-D pivot in a second vertical reference plane perpendicular to the first vertical reference plane and transverse to the longitudinal axis of the firearm.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with ambidextrous bolt release mechanism comprising:

a longitudinal axis;

a barrel;

a bolt slideably movable between a forward closed breech position in battery with the barrel and a rearward open breech position;

a recoil spring biasing the bolt forward towards the closed breech position;

a manually actuated bolt catch lever movably mounted on a first lateral side of the receiver, the bolt catch lever being axially elongated in the direction of the longitudinal axis, the bolt catch lever being pivotably movable about a pivot axis between an engaged position and a disengaged position;

the bolt catch lever including a bolt catch protrusion configured and operable to selectively (1) engage a locking ledge formed on the bolt for holding the bolt in the open breech position when the bolt catch lever is in the engaged position, and (2) disengage the locking ledge for releasing the bolt from the open breech position forward when the bolt catch lever is in the disengaged position;

a manually depressible actuator plunger slideably movable and extending transversely from a second lateral side of the receiver to the first lateral side, the actuator plunger comprising an operating end including an exposed head disposed on the second lateral side and a working end disposed on the first lateral side which is selectively engageable with the bolt catch lever;

wherein the actuator plunger when actuated via the operating end is operable to engage and rotate the bolt catch lever from the engaged position to the disengaged position.

2. The firearm according to claim 1, wherein the pivot axis of the bolt catch lever is transversely oriented to the longitudinal axis of the firearm.

3. The firearm according to claim 2, wherein the working end of the actuator plunger slideably engages the bolt catch lever when the actuator plunger is actuated by a user.

4. The firearm according to claim 2, wherein the bolt catch lever pivots in a vertical reference plane, and the actuator plunger is slideably moveable transverse to the longitudinal axis of the firearm between an actuated position operably engaged with the bolt catch lever and an unactuated position operably disengaged from the bolt catch lever.

5. The firearm according to claim 4, further comprising a plunger spring biasing the actuator plunger towards the unactuated position.

6. The firearm according to claim 2, wherein the working end of the actuator plunger includes an inclined camming surface which slideably engages a corresponding inclined camming ramp formed on the bolt catch lever to pivot the bolt catch lever from the engaged position to the disengaged position when the actuator plunger depressed.

7. The firearm according to claim 6, wherein the camming surface of the actuator plunger is formed by a conical tip on the working end.

8. The firearm according to claim 6, wherein the camming ramp is disposed on a front portion of the bolt catch lever forward of the pivot axis and the bolt catch protrusion is disposed on a rear portion of the bolt catch lever rearward of the pivot axis.

9. The firearm according to claim 8, wherein the camming ramp is formed on an underside of a front end of the bolt catch lever.

10. The firearm according to claim 9, wherein the camming ramp is sloped laterally in a transverse direction to the longitudinal axis of the firearm.

11. The firearm according to claim 10, wherein the inclined camming surface and the camming ramp have complementary angles so that a flat-to-flat sliding interface is formed therebetween in operation of the plunger to displace and raise the bolt catch lever.

12. The firearm according to claim 4, wherein moving the actuator plunger laterally inwards from the unactuated position to the actuated position raises the front end of the bolt catch lever and correspondingly lowers the bolt catch protrusion to disengage the locking ledge of the bolt.

13. The firearm according to claim 2, further comprising a catch spring biasing the bolt catch lever downwards towards the disengaged position.

14. The firearm according to claim 2, wherein the bolt catch lever further comprises a manually-operated actuating handle disposed on the rear portion thereof, the actuating handle being operable by a user to move the bolt catch lever from the engaged position to disengaged position, and vice-versa.

15. The firearm according to claim 14, wherein the bolt catch lever further comprises a follower engagement protrusion extending transversely inward towards a magazine well of the firearm, the follower engagement protrusion being engageable by a spring-biased follower of an ammunition magazine when mounted in the magazine well which automatically moves the bolt catch lever from the disengaged position to the engaged position.

16. The firearm according to claim 15, wherein the follower engagement protrusion is formed on the rear portion of the bolt catch lever between the pivot axis and the actuating handle.

17. The firearm according to claim 2, wherein the bolt catch lever and actuator plunger are mounted to a fire control insert detachably coupled to the receiver.

18. The firearm according to claim 17, wherein the fire control insert includes a firing mechanism comprising a trigger operably linked to a spring-biased hammer movable between a rearward cocked position and forward firing position to discharge the firearm.

19. The firearm according to claim 1, wherein the locking ledge is formed in a lateral side of the bolt proximate to a bottom of the bolt.

20. A method for operating an ambidextrous bolt catch of a firearm, the method comprising:

providing the firearm comprising a bolt movable into and out of battery with a barrel, the bolt catch comprising a bolt catch lever pivotably mounted on a first lateral side of the firearm and an actuator plunger accessible to a user from a second lateral side of the firearm;

moving the bolt from a forward closed breech position to a rearward open breech position;

rotating the bolt catch lever about a pivot axis in a first direction;

engaging a bolt catch lever with the bolt, wherein the bolt is restrained in the open breech position by the bolt catch;

sliding the actuator plunger in an inwards transverse direction towards the bolt catch lever from an unactuated position to an actuated position;

slideably engaging an inclined camming surface on the actuator plunger with an inclined camming ramp on the bolt catch lever; and rotating the bolt catch lever about the pivot axis in a second direction which disengages and releases the bolt from the open breech position.

* * * * *